US006614463B2

(12) United States Patent
Kerr et al.

(10) Patent No.: US 6,614,463 B2
(45) Date of Patent: Sep. 2, 2003

(54) IMAGE PROCESSING APPARATUS WITH CONDUIT TUBE AND BLOWER

(75) Inventors: Roger S. Kerr, Brockport, NY (US); Seung H. Baek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 13 days.

(21) Appl. No.: 09/972,678

(22) Filed: Oct. 5, 2001

(65) Prior Publication Data

US 2003/0067531 A1 Apr. 10, 2003

(51) Int. Cl.[7] ..... B41J 27/00
(52) U.S. Cl. ..... 347/241; 347/256
(58) Field of Search ..... 347/234, 232, 347/238, 241, 250, 256; 385/123; 219/632, 757

(56) References Cited

U.S. PATENT DOCUMENTS

| | | | | |
|---|---|---|---|---|
| 4,572,609 A | * | 2/1986 | Sakuragi et al. | 385/123 |
| 5,053,791 A | | 10/1991 | Baek et al. | 346/138 |
| 5,164,742 A | | 11/1992 | Baek et al. | 347/234 |
| 5,168,288 A | | 12/1992 | Baek et al. | 347/240 |
| 5,175,564 A | | 12/1992 | Jamzadeh | 346/116 |
| 5,214,444 A | | 5/1993 | Kerr et al. | 347/238 |
| 5,260,714 A | | 11/1993 | DeCook et al. | 347/264 |
| 5,268,708 A | | 12/1993 | Harshbarger et al. | 427/322 |
| 5,270,731 A | | 12/1993 | Kerr et al. | 346/24 |
| 5,276,464 A | | 1/1994 | Kerr et al. | 346/134 |
| 5,301,099 A | | 4/1994 | Kerr | 346/138 |
| 5,323,180 A | | 6/1994 | Kuberka et al. | 347/215 |
| 5,341,159 A | | 8/1994 | Kerr | 346/134 |
| 5,376,954 A | | 12/1994 | Kerr | 346/138 |
| 5,446,477 A | | 8/1995 | Baek et al. | 346/138 |
| 5,777,658 A | | 7/1998 | Kerr et al. | 347/215 |
| 5,838,345 A | | 11/1998 | Kerr et al. | 347/37 |
| 5,973,717 A | * | 10/1999 | Kerr et al. | 347/234 |
| 6,002,419 A | | 12/1999 | Kerr et al. | 347/233 |
| 6,014,162 A | | 1/2000 | Kerr et al. | 347/262 |
| 6,037,960 A | | 3/2000 | Kerr et al. | 347/172 |

* cited by examiner

*Primary Examiner*—Hai Pham
(74) *Attorney, Agent, or Firm*—Harleston Law Firm

(57) ABSTRACT

An image processing apparatus (10) for forming images on a thermal print media includes: a) a rotatable drum (300); b) a motor for rotating the drum (300); c) at least one movable printhead (500) external to the drum (300); d) thermal print media (32) removably mounted on the drum (300), the printhead (500) being positioned to move over the thermal print media (32) on the drum (300); e) an imaging assembly (400); f) at least one connection means, preferably fiber optic cables (404), for connecting the imaging assembly (400) to the printhead (500); g) at least one conduit tube (510) for conducting the connection means (404) between the imaging assembly and the printhead (500), one end of the conduit tube (510) being affixed to the printhead (500), an opposite end of the conduit tube being connected to the imaging assembly (400); and h) an air moving device, preferably a cooler (710) or blower (730, 740), connecting directly or indirectly to the conduit tube (510) at the opposite end of the conduit tube. A process for eliminating foreign particles from and/or cooling the printhead area is also included herein.

12 Claims, 13 Drawing Sheets

IMAGE PROCESSING APPARATUS WITH CONDUIT TUBE AND BLOWER

FIELD OF THE INVENTION

The present invention relates in general to image processing apparatus and related processes, and in particular, to an image processing apparatus with a blower and preferably a cooler, and a related process for blowing preferably cool air down a conduit tube to a printhead at the other end, or vacuuming foreign particles from the printhead area through the conduit tube.

BACKGROUND OF THE INVENTION

Pre-press color-proofing is a procedure that is used by the printing industry for creating representative images of printed material without the high cost and time that is required to actually produce printing plates and set up a high-speed, high volume, printing press to produce an example of an intended image. An image may require several corrections and be reproduced several times to satisfy or meet the customers requirements resulting in a large loss of profits and ultimately higher costs to the customer.

One such commercially available image processing apparatus is arranged to form an intended image on a sheet of thermal print media. Dye is transferred from a sheet of dye donor material to the thermal print media by applying a sufficient amount of thermal energy to the dye donor sheet material to form the intended image. This image processing apparatus generally includes a material supply assembly or carousel, and a lathe bed scanning subsystem or write engine, which includes a lathe bed scanning frame, translation drive, translation stage member, printhead, load roller, and imaging drum, and thermal print media and dye donor sheet material exit transports.

Operation of the image processing apparatus includes metering a length of the thermal print media (in roll form) from the material assembly or carousel. The thermal print media is then cut into sheet form of the required length and transported to the imaging drum. It is then registered, wrapped around, and secured onto the imaging drum. The load roller, which is also known as a squeegee roller, removes entrained air between the drum and the thermal print media. Next, a length of dye donor material (in roll form) is metered out of the material supply assembly or carousel, and cut into sheet form of the required length. It is then transported to the imaging drum and wrapped around it. A load roller is used to remove any air trapped between the imaging drum and the dye donor material. The dye donor material is superposed in the desired registration with respect to the thermal print media, which has already been secured to the imaging drum.

After the dye donor sheet material is secured to the periphery of the imaging drum, the scanning subsystem or write engine provides the scanning function. This is accomplished by retaining the thermal print media and the dye donor sheet material on the spinning imaging drum while it is rotated past the printhead to form an intended image on the thermal print media. The translation drive then traverses the printhead and translation stage member axially along the axis of the imaging drum in coordinated motion with the rotating imaging drum. These movements combine to produce the intended image on the thermal print media. The printhead is movable relative to the longitudinal axis of the imaging drum.

A number of laser diodes are tied to the printhead and can be individually modulated to supply energy to selected areas of the thermal print media in accordance with an information signal. The printhead includes a plurality of optical fibers coupled to the laser diodes at one end, and at their opposite ends to a fiber optic array within the printhead. The printhead is movable relative to the longitudinal axis of the imaging drum. The dye is transferred to the thermal print media as the radiation, which is transferred from the laser diodes by the optical fibers to the printhead and thus to the dye donor sheet material, is converted to thermal energy in the dye donor sheet material.

After the intended image has been formed on the thermal print media, the dye donor sheet material is removed from the imaging drum without disturbing the thermal print media beneath it. The dye donor sheet material is then transported out of the image processing apparatus. Additional dye donor sheet materials are sequentially superimposed with the thermal print media on the imaging drum, further producing an intended image. The completed image on the thermal print media is then unloaded from the imaging drum and transported to an external holding tray on the image processing apparatus.

Although the presently known and utilized image processing apparatus is satisfactory, it is not without drawbacks. Images, and the apparatus itself over time, can be contaminated or blocked by dust or small particles generated by the imaging process. Temperatures in many image processing apparatus can get very hot, sometimes approaching several hundred degrees Fahrenheit. With the present apparatus, the printhead area can be cooled, and dust and other particles in the area can be reduced, thus decreasing contamination and improving overall image quality.

Also, the present invention can be extended to cover an image: processing device that utilizes more than one imaging station, such as a printing press, where each station images a different plate used to produce a different color. With such a design, it is important that each station be controlled thermally, in some cases capable of skiving material, and kept free of foreign material to provide the proper image quality. Minor changes in the printhead due to thermal effects or foreign material can lead to objectionable effects in the output image.

SUMMARY OF THE INVENTION

The present invention is an image processing apparatus for forming images on a thermal print media, comprising: a) a rotatable drum; b) a motor for rotating the drum; c) at least one movable printhead external to the drum; d) thermal print media removably mounted on the drum, the printhead being positioned to move over the thermal print media on the drum; e) an imaging assembly; f) at least one connection means for connecting the imaging assembly to the printhead; g) at least one conduit tube for conducting the connection means between the imaging assembly and the printhead, one end of the conduit tube being affixed to the printhead, an opposite end of the conduit tube being connected to the imaging assembly; and h) an air moving device connecting directly or indirectly to the conduit tube at the opposite end of the conduit tube. The air moving device may be a cooler, a positive air blower, and/or a vacuum blower. A process for eliminating foreign particles from the printhead area is also included herein.

Advantages of the present invention include one or more of the following: 1) cooling the printhead to protect against adverse effects of high temperatures; 2) allowing a straightforward method of removing material skived from the thermal media to form the intended image; 3) preventing foreign material and other undesirable particles from contaminating the printhead; 4) working within existing designs for the writing drum and for imaging support subsystems without major redesign of existing systems to achieve these benefits; 5) vacuuming foreign particles away from the apparatus in a manner which allows proper disposal of contaminants; 6) improving output of the intended image; and 7) allowing these advantages for multiple stations in the case of a printing press, for example.

BRIEF DESCRIPTION OF THE DRAWINGS

A more complete understanding of the invention and its advantages will be apparent from the detailed description taken in conjunction with the accompanying drawings, wherein examples of the invention are shown, and wherein.

DETAILED DESCRIPTION OF THE INVENTION

Figure 1:
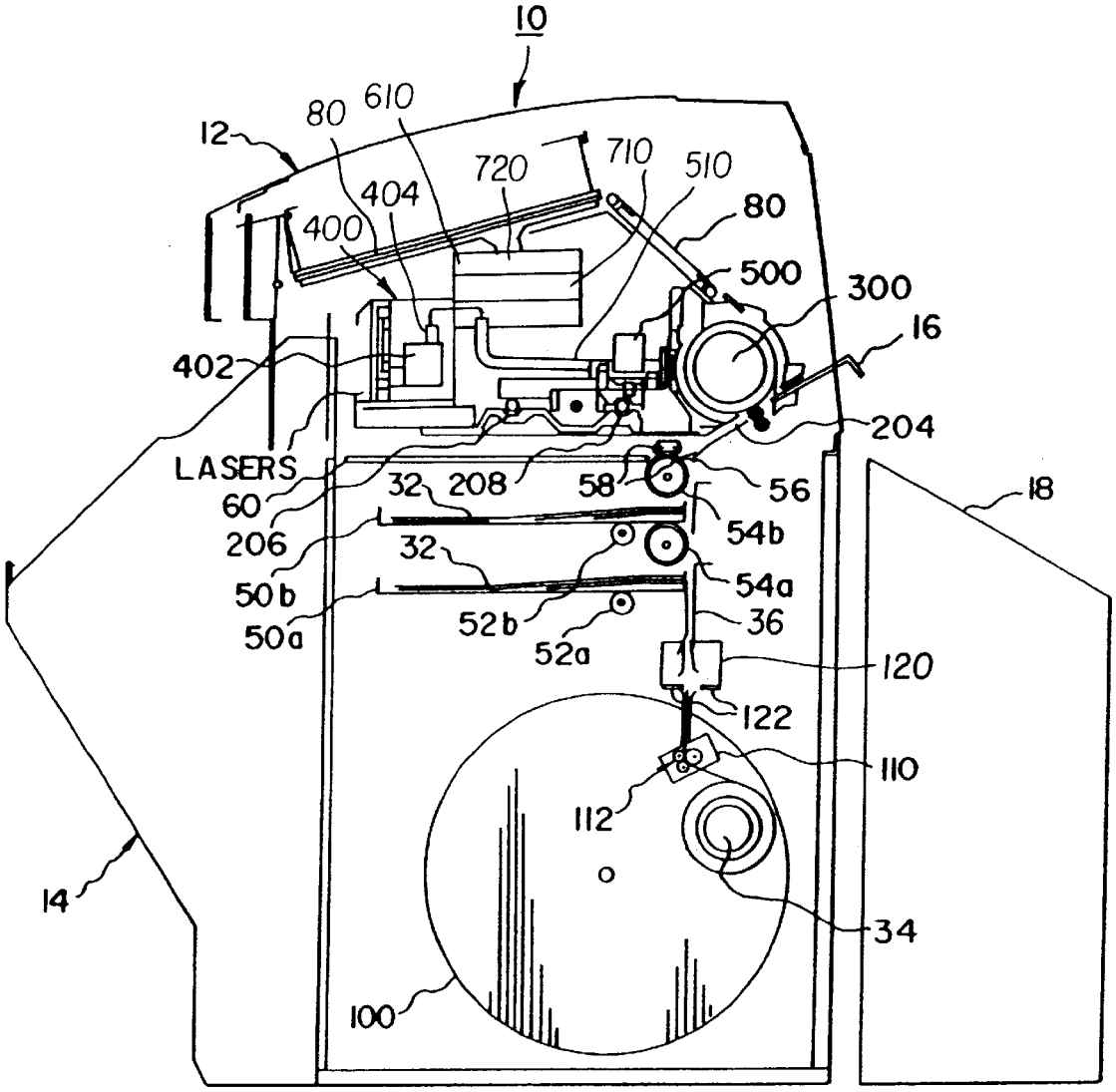
FIG. 1 is a side view in vertical cross-section of an image processing apparatus according to the present invention, showing a cooler.

In the following description, like reference characters designate like or corresponding parts throughout the several views. Also, in the following description, it is to be understood that such terms as "front," "rear," "lower," "upper," and the like are words of convenience and are not to be construed as limiting terms. Referring in more detail to the drawings, the invention will now be described.

Turning first to FIG. 1, an image processing apparatus according to the present invention, which is generally referred to as 10, includes an image processor housing 12, which provides a protective cover for the apparatus. The apparatus 10 also includes a hinged image processor door 14, which is attached to the front portion of the image processor housing 12 and permits access to the two sheet material trays. A lower sheet thermal print material tray 50*a* and upper sheet input image material tray 50*b* are positioned in the interior portion of the image processor housing 12 for supporting thermal print media 32, or an input image, thereon. Only one of the sheet material trays 50 will dispense the thermal print media 32 out of the sheet material tray 50 to create an intended image thereon. The alternate sheet material tray either holds an alternative type of thermal print media 32, or an input image, or functions as a back up sheet material tray. In this regard, lower sheet material tray 50*a* includes a lower media lift cam 52*a*, which is used to lift the lower sheet material tray 50*a* and, ultimately, the thermal print media 32 upwardly toward lower media roller 54*a* and upper media roller 54*b*. When the media rollers 54*a, b* are both rotated, the thermal print media 32 is pulled upwardly towards a media guide 56. The upper sheet input image material tray 50*b* includes an upper media lift cam 52*b* for lifting the upper sheet thermal print material tray 50*b* and, ultimately, the thermal print media 32 towards the upper media roller 54*b*, which directs it toward the media guide 56.

Continuing with FIG. 1, the movable media guide 56 directs the thermal print media 32 under a pair of media guide rollers 58. This engages the thermal print media 32 for assisting the upper media roller 54*b* in directing it onto the media staging tray 60. The media guide 56 is attached and hinged to the lathe bed scanning frame 202 at one end, and is uninhibited at its other end for permitting multiple positioning of the media guide 56. The media guide 56 then rotates the uninhibited end downwardly, as illustrated. The direction of rotation of the upper media roller 54*b* is reversed for moving the thermal print medium receiver sheet material 32, which is resting on the media staging tray 60, under the pair of media guide rollers 58 upwardly through an entrance passageway 204 and up to the imaging drum 300.

A roll 30 of dye donor material 34 is connected to the media carousel 100 in a lower portion of the image processor housing 12, as shown in FIG. 1. Four rolls 30 are ordinarily used, but, for clarity, only one is shown in FIG. 1. Each roll 30 includes a dye donor material 34 of a different color, typically black, yellow, magenta and cyan. These dye donor materials 34 are ultimately cut into dye donor sheet materials 36 and passed to the imaging drum 300 for forming the medium from which dyes embedded therein are passed to the thermal print media 32 resting thereon. In this regard, a media drive mechanism 110 is attached to each roll 30 of dye donor material 34, and includes three media drive rollers 112 through which the dye donor material 34 of interest is metered upwardly into a media knife assembly 120. After the dye donor material 34 reaches a predetermined position, the media drive rollers 112 cease driving the dye donor material 34. Two media knife blades 122 positioned at the bottom portion of the media knife assembly 120 cut the dye donor material 34 into dye donor sheet materials 36. The lower media roller 54*a* and the upper media roller 54*b* along with the media guide 56 then pass the dye donor sheet material 36 onto the media staging tray 60 and ultimately to the imaging drum 300.

FIG. 1 shows an imaging drum 300 and a load roller 350. Once the thermal print medium receiver sheet material 32 is moved into position, the load roller 350 is moved into contact with the thermal print medium receiver sheet material 32 against the imaging drum 300.

As shown in FIG. 1, a laser assembly 400 includes a quantity of laser diodes 402 in its interior. The laser diodes are connected to fiber optic cables 404, and ultimately to a printhead 500. The fiber optic cables 404 are bundled in a fiber optic tube, or conduit tube 510, one end of which is connected to the printhead 500. In line between the laser assembly 400 and the printhead 500 is a cooler housing 610, which encloses a filtration system 720 in series with a cooler 710. When the image processing apparatus 10 is in use, cooled, filtered air from the filtration system 720 and the cooler 710 is blown down the conduit tube to the printhead 500. The printhead 500 directs thermal energy received from the laser diodes 402. This causes the dye donor sheet material 36 to pass the desired color across the gap to the thermal print media 32.

Figure 2:
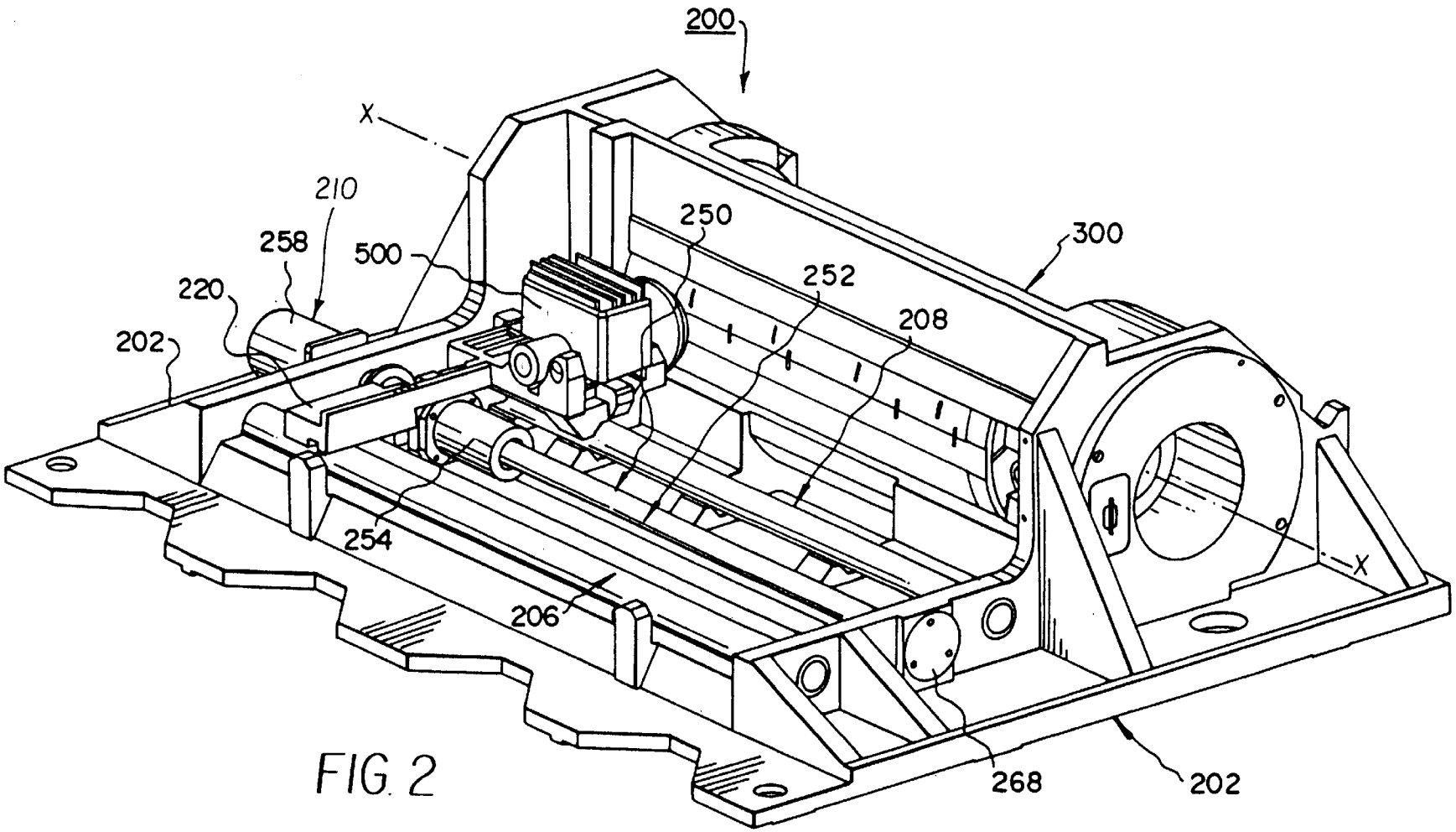
FIG. 2 is a perspective view of an image processing apparatus according to the present invention.

The printhead 500 attaches to a lead screw 250 (see FIG. 2). A lead screw drive nut 254 and drive coupling (not shown) permit axial movement along the longitudinal axis of the imaging drum 300 for transferring the data to create the intended image onto the thermal print media 32.

For writing, the imaging drum 300 rotates at a constant velocity. The printhead 500 begins at one end of the thermal print media 32 and traverses the entire length of the thermal print media 32 for completing the transfer process for the particular dye donor sheet material 36 resting on the thermal print media 32. After the printhead 500 completes the transfer process for the particular dye donor sheet material 36 resting on the thermal print media 32, the dye donor sheet material 36 is removed from the imaging drum 300 and transferred out of the image processor housing 12 via a skive or ejection chute 16. The dye donor sheet material 36 eventually comes to rest in a waste bin 18 for removal by the user. The above-described process is then repeated for the other three rolls 30 of dye donor materials 34.

Continuing with FIG. 1, after the color from all four sheets of the dye donor sheet materials 36 has been transferred, the dye donor sheet material 36 is removed from the imaging drum 300. The thermal print media 32 with the intended image thereon is then removed from the imaging drum 300 and transported via a transport mechanism 80 out of the image processor housing 12 and comes to rest against a media stop 20.

Operation of the image processing apparatus 10 includes metering a length of the thermal print media (in roll form) from the material assembly or carousel. The thermal print media 32 is then measured and cut into sheet form of the required length and transported to the imaging drum 300. It is then registered, wrapped around, and secured onto the drum 300. Next, a length of dye donor material (in roll form) 34 is metered out of the material supply assembly or carousel, measured, and cut into sheet form of the required length. It is then transported to the imaging drum 300 and wrapped around the imaging drum using the load roller 350, so that it is superposed in the desired registration with respect to the thermal print media, which has already been secured to the imaging drum.

After the dye donor sheet material 36 is secured to the periphery of the imaging drum 300, the lathe bed scanning subsystem 200 or write engine provides the scanning function. This is accomplished by retaining the thermal print media 32 and the dye donor sheet material 36 on the spinning imaging drum 300 while it is rotated past the printhead 500 that will expose the thermal print media 32. The translator drive 258 then traverses the printhead 500 and translation stage member 220 axially along the axis of the imaging drum in coordinated motion with the rotating imaging drum 300. These movements combine to produce the intended image on the thermal print media 32.

Continuing with a description of the operation of the apparatus, the media carousel 100 is rotated about its axis into the desired position, so that the thermal print media 32 or dye donor material (in roll form) 34 can be withdrawn, measured, and cut into sheet form of the required length, and then transported to the imaging drum. To accomplish this, the media carousel 100 has a vertical circular plate, preferably with, though not limited to, six material support spindles. The support spindles are arranged to carry one roll of thermal print media, and four rolls of dye donor material. They provide the four primary colors, which are preferably used in the writing process to form the intended image. One roll is used as a spare or for a specialty color dye donor material, if so desired. Each spindle has a feeder assembly to withdraw the thermal print media or dye donor material from the spindles.

Turning to FIG. 2, the image processing apparatus 10 includes the imaging drum 300, printhead 500, and lead screw 250, which are assembled in the lathe bed scanning frame 202. The imaging drum 300 is mounted for rotation about an axis X in the lathe bed scanning frame 202. The printhead 500 is movable with respect to the imaging drum 300, and is arranged to direct a beam of light to the dye donor sheet material 36. The beam of light from the printhead 500 for each laser diode 402 (shown in FIG. 1) is modulated individually by modulated electronic signals from the image processing apparatus 10. These are representative of the shape and color of the original image. The color on the dye donor sheet material 36 is heated to cause volatilization only in those areas in which its presence is required on the thermal print media 32 to reconstruct the shape and color of the original image.

Continuing with FIG. 2, the printhead 500 is mounted on a movable translation stage member 220, which is supported for low friction movement on translation bearing rods 206, 208. The linear translation subsystem 210 includes the translation stage member 220, the translation bearing rods 206, 208, and the translator drive 258. The translation bearing rods 206, 208 are sufficiently rigid so as not sag or distort between mounting points and are arranged as parallel as possible with the axis X of the imaging drum 300, with the axis of the printhead 500 perpendicular to the axis X of the imaging drum 300 axis. The front translation bearing rod 208 locates the translation stage member 220 in the vertical and the horizontal directions with respect to axis X of the imaging drum 300. The rear translation bearing rod 206 locates the translation stage member 220 only with respect to rotation of the translation stage member 220 about the front translation bearing rod 208. This is done so that there is no over-constraint of the translation stage member 220, which might cause it to bind, chatter, or otherwise impart undesirable vibration or jitters to the printhead 500 during the generation of an intended image. The translator drive 258 traverses the translation stage member and printhead axially along the imaging drum.

Figure 3:
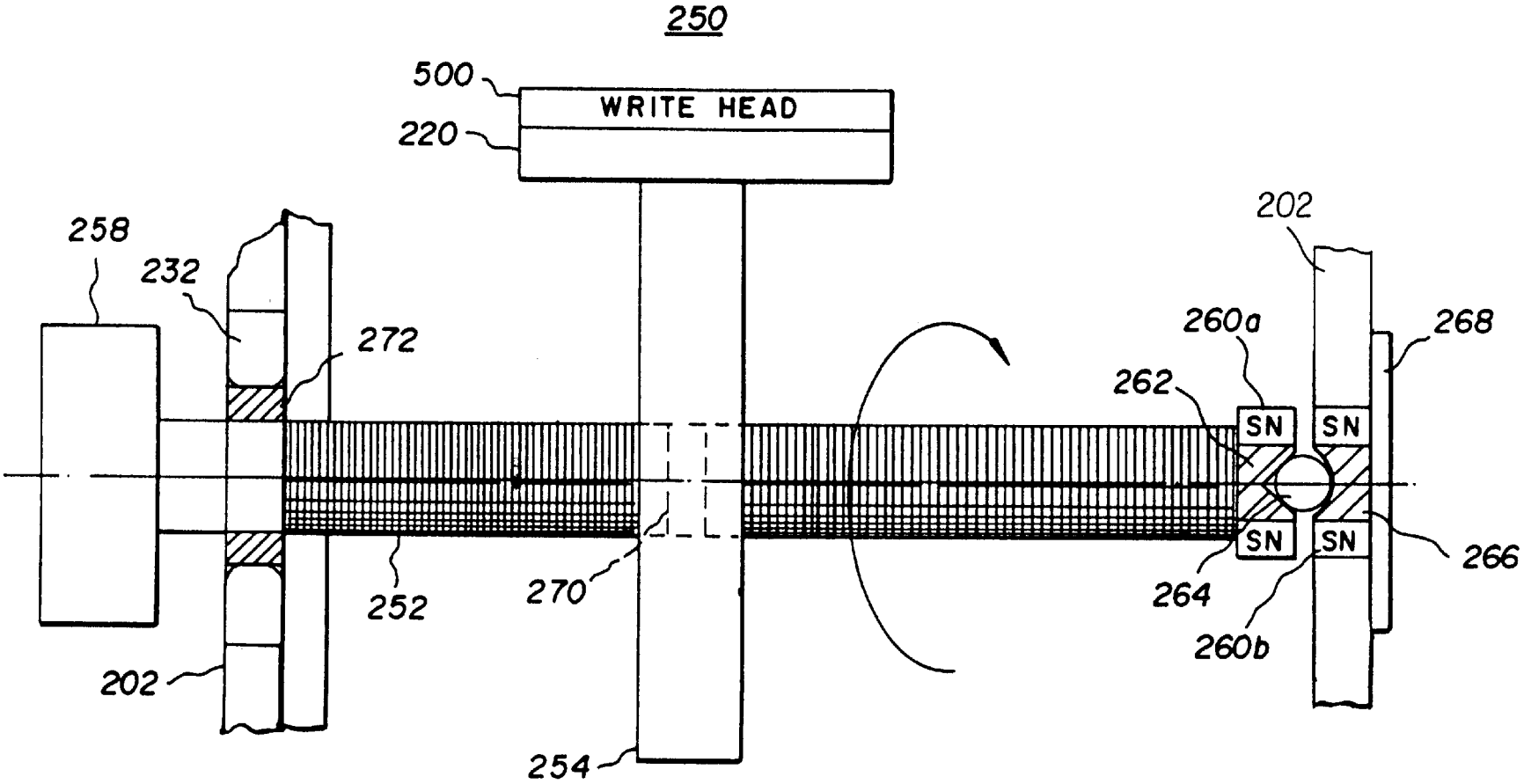
FIG. 3 is a top view in horizontal cross section, partially in phantom, of a lead screw according to the present invention.

Referring to FIGS. 2 and 3, the lead screw 250 includes an elongated, threaded shaft 252, which is attached to the translator linear drive motor 258 on its drive end and to the lathe bed scanning frame 202 by means of a radial bearing 272. A lead screw drive nut 254 includes grooves in its hollowed-out center portion 270 for mating with the threads of the threaded shaft 252. This allows the lead screw drive nut 254 axial movement along the threaded shaft 252 as the threaded shaft 252 is rotated by the linear drive motor 258. The lead screw drive nut 254 is integrally attached to the to the printhead 500 through the lead screw coupling (not shown) and the translation stage member 220 at its periphery, so that the threaded shaft 252 is rotated by the linear drive motor 258. This moves the lead screw drive nut 254 axially along the threaded shaft 252, which in turn moves the translation stage member 220, and ultimately the printhead 500 axially along the imaging drum 300.

As best illustrated in FIG. 3, an annular-shaped axial load magnet 260*a* is integrally attached to the driven end of the threaded shaft 252, and is in a spaced-apart relationship with another annular-shaped axial load magnet 260*b* attached to the lathe bed scanning frame 202. The axial load magnets 260*a* and 260*b* are preferably made of rare-earth materials such as neodymium-iron-boron. A generally circular-shaped boss 262 part of the threaded shaft 252 rests in the hollowed-out portion of the annular-shaped axial load magnet 260*a*, and includes a generally V-shaped surface at the end for receiving a ball bearing 264. A circular-shaped insert 266 is placed in the hollowed-out portion of the other annular-shaped axial load magnet 260*b*. It has an arcuate-shaped surface at one end for receiving ball bearing 264, and a flat surface at its other end for receiving an end cap 268 placed over the annular-shaped axial load magnet 260*b*, which is attached to the lathe bed-scanning frame 202 for protectively covering the annular-shaped axial load magnet 260*b*. This provides an axial stop for the lead screw 250.

Continuing with FIG. 3, the linear drive motor 258 is energized and imparts rotation to the lead screw 250, as indicated by the arrows. This causes the lead screw drive nut 254 to move axially along the threaded shaft 252. The annular-shaped axial load magnets 260*a*, 260*b* are magnetically attracted to each other, which prevents axial movement of the lead screw 250. The ball bearing 264, however, permits rotation of the lead screw 250 while maintaining the positional relationship of the annular-shaped axial load magnets 260, i.e., slightly spaced apart. Mechanical friction between them is thus prevented, yet the threaded shaft 252 can continue to rotate.

The printhead 500 travels in a path along the drum 300, moving at a speed synchronous with the drum 300 rotation and proportional to the width of the writing swath. The pattern transferred by the printhead 500 to the thermal print media 32 along the imaging drum 300 is a helix.

In operation, the scanning subsystem 200 or write engine contains the mechanisms that provide the mechanical actuations for the imaging drum positioning and motion control to facilitate placement of loading onto, and removal of the thermal print media 32 and the dye donor sheet material 36 from the imaging drum 300. The scanning subsystem 200 or write engine provides the scanning function by retaining the thermal print media 32 and dye donor sheet material 36 on the rotating imaging drum 300. This generates a once per revolution timing signal to the data path electronics as a clock signal, while the translator drive 258 traverses the translation stage member 220 and printhead 500 axially along the imaging drum 300 in a coordinated motion with the imaging drum rotating past the printhead. Positional accuracy is maintained in order to control the placement of each pixel, so that the intended image produced on the thermal print media is precise.

During operation, the lathe bed scanning frame 202 supports the imaging drum and its rotational drive. The translation stage member 220 and write head are supported by the two translation bearing rods 206, 208 that are positioned parallel to the imaging drum and lead screw. They are parallel to each other and form a plane therein, along with the imaging drum and lead screw. The translation bearing rods are, in turn, supported by the outside walls of the lathe bed scanning frame of the lathe bed scanning subsystem or write engine. The translation bearing rods are positioned and aligned therebetween.

The translation drive 258 is for permitting relative movement of the printhead 500 by means of a DC servomotor and encoder, which rotates the lead screw 250 parallel with the axis of the imaging drum 300. The printhead 500 is placed on the translation stage member 220 in the "V" shaped grooves. The "V" shaped grooves are in precise relationship to the bearings for the front translation stage member 220 supported by the front and rear translation bearing rods 206, 208. The translation bearing rods are positioned parallel to the imaging drum 300. The printhead is selectively locatable with respect to the translation stage member; thus it is positioned with respect to the imaging drum surface. The printhead has a means of adjusting the distance between the printhead and the imaging drum surface, and the angular position of the printhead about its axis using adjustment screws. An extension spring provides a load against these two adjustment means. The translation stage member 220 and printhead 500 are attached to the rotational lead screw 250, which has a threaded shaft, by a drive nut and coupling. The coupling is arranged to accommodate misalignment of the drive nut and lead screw so that only forces parallel to the linear lead screw and rotational forces are imparted to the translation stage member by the lead screw and drive nut. The lead screw rests between two sides of the lathe bed scanning frame 202, where it is supported by deep groove radial bearings. At the drive end, the lead screw 250 continues through the deep groove radial bearing through a pair of spring retainers. The spring retainers are separated and loaded by a compression spring, and to a DC servomotor and encoder. The DC servomotor induces rotation to the lead screw 250, which moves the translation stage member 220 and printhead 500 along the threaded shaft as the lead screw 250 is rotated. Lateral movement of the printhead 500 is controlled by switching the direction of rotation of the DC servomotor and thus the lead screw 250.

The printhead 500 includes a number of laser diodes 402, which are tied to the printhead and can be individually modulated to supply energy to selected areas of the thermal print media 32 in accordance with an information signal. The printhead 500 of the image processing apparatus 10 includes a plurality of optical fibers, which are coupled to the laser diodes 402 at one end and at the opposite end to a fiber optic array within the printhead. The printhead 500 is movable relative to the longitudinal axis of the imaging drum 300. The dye is transferred to the thermal print media 32 as radiation is transferred from the laser diodes by the optical fibers to the printhead, and thus to the dye donor sheet material 36, and is converted to thermal energy in the dye donor sheet material.

Figure 4:
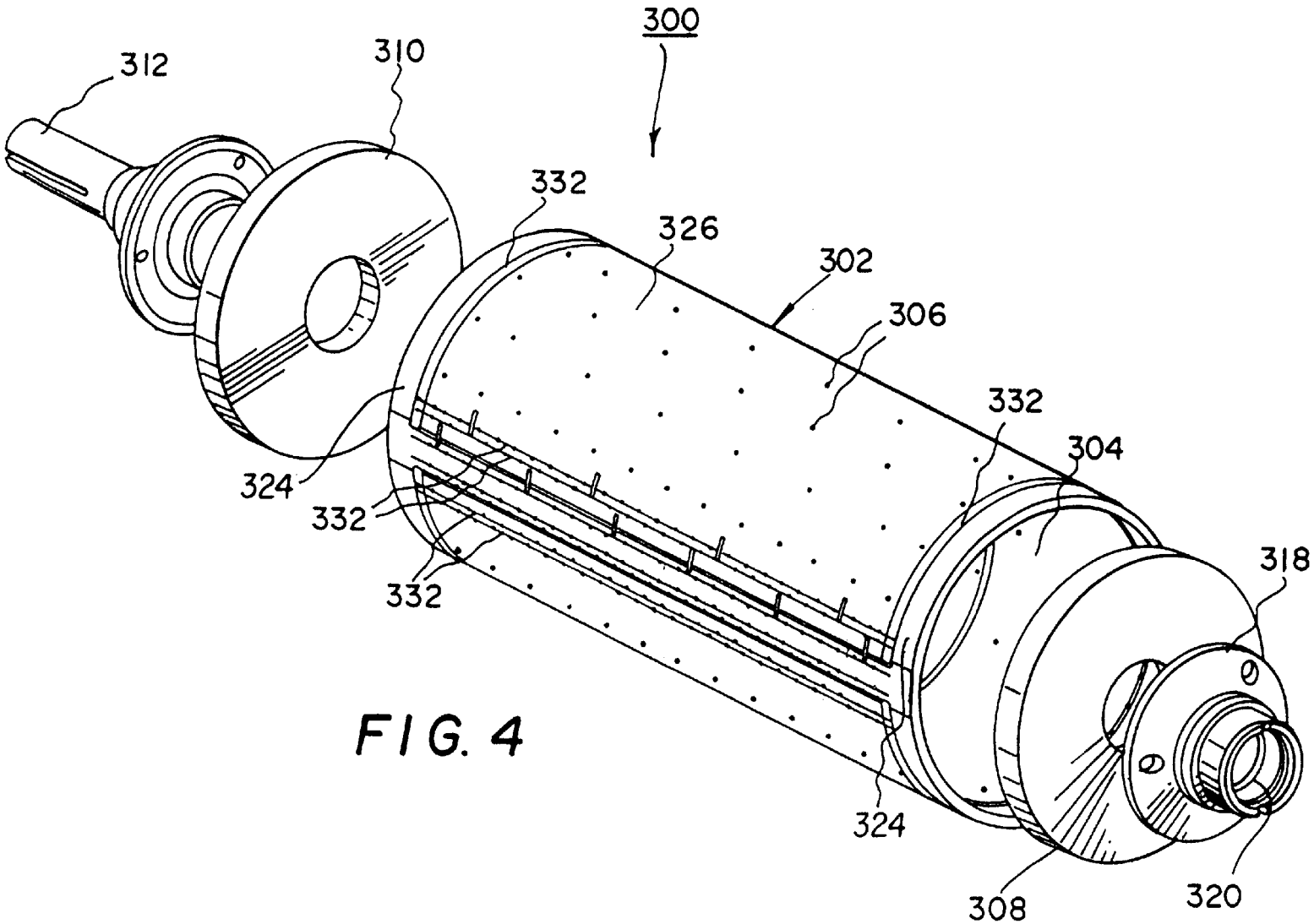
FIG. 4 is an exploded, perspective view of a vacuum imaging drum according to the present invention.

Referring to FIG. 4, the rotatable imaging drum 300 has a cylindrical-shaped vacuum drum housing 302. The imaging drum 300 includes a hollowed-out interior portion 304, and a number of vacuum grooves 332 and vacuum holes 306 extending through the vacuum drum housing 302. Vacuum is applied from the hollow interior portion 304 of the imaging drum 300 through these vacuum grooves and holes.

The vacuum supports and maintains the position of the thermal print media 32 and the dye donor sheet material 36, even as the imaging drum 300 rotates.

Continuing with FIG. 4, the ends of the imaging drum 300 are closed by a vacuum end plate 308, and a drive end plate 310. The drive end plate 310 is provided with a centrally disposed drive spindle 312, which extends outwardly therefrom through a support bearing. The vacuum end plate 308 is provided with a centrally disposed vacuum spindle 318, which extends outwardly therefrom through another support bearing.

The drive spindle 312 extends through the support bearing and is stepped down to receive a DC drive motor armature (not shown), which is held on by a drive nut. A DC motor stator (not shown) is stationarily held by the late bed scanning frame member 202 (see FIGS. 1 and 2), encircling the DC drive motor armature to form a reversible, variable DC drive motor for the imaging drum 300. A drum encoder mounted at the end of the drive spindle 312 provides timing signals to the image processing apparatus 10.

As shown in FIG. 4, the vacuum spindle 318 is provided with a central vacuum opening 320. The central vacuum opening 320 is in alignment with a vacuum fitting with an external flange that is rigidly mounted to the lathe bed scanning frame 202 (see FIGS. 1 and 2). The vacuum fitting has an extension, which extends within but is closely spaced from the vacuum spindle 318, thus forming a small clearance. With this configuration, a slight vacuum leak is provided between the outer diameter of the vacuum fitting and the inner diameter of the central vacuum opening 320 of the vacuum spindle 318. This assures that no contact exists between the vacuum fitting and the imaging drum 300 that might impart uneven movement or jitters to the imaging drum 300 during its rotation.

The opposite end of the vacuum fitting is connected to a high-volume vacuum blower (not shown), which is capable of producing 50–60 inches of water at an air flow volume of 60–70 CFM. The vacuum blower provides vacuum to the imaging drum 300. The vacuum blower provides the various internal vacuum levels required during loading, scanning and unloading of the thermal print media 32 and the dye donor sheet materials 36 to create the intended image. With no media loaded on the imaging drum 300, the internal vacuum level of the imaging drum 300 is preferably approximately 10–15 inches of water. With just the thermal print media 32 loaded on the imaging drum 300, the internal vacuum level of the imaging drum 300 is preferably approximately 20–25 inches of water. This level is desired so that when a dye donor sheet material 36 is removed, the thermal print media 32 does not move and color to color registration is maintained. With both the thermal print media 32 and dye donor sheet material 36 completely loaded on the imaging drum 300, the internal vacuum level of the imaging drum 300 is approximately 50–60 inches of water in this embodiment.

In operation, vacuum is applied through the vacuum holes 306 extending through the drum housing 302. The vacuum supports and maintains the position of the thermal print media 32 and dye donor sheet material 36 as the imaging drum 300 rotates. The ends of the imaging drum are preferably enclosed by the cylindrical end plates, which are each provided with a centrally disposed spindle 318. The spindles extend outwardly through support bearings and are supported by the scanning frame. The drive end spindle extends through the support bearing and is stepped down to receive the motor armature, which is held on by a nut. The stator is held by the scanning frame, which encircles the armature to form the reversible, variable speed DC drive motor for the imaging drum. An encoder mounted at the end of the spindle provides timing signals to the image processing apparatus. The central vacuum opening 320 on the opposite spindle 318 is in alignment with a vacuum fitting with an external flange that is rigidly mounted to the lathe bed scanning frame 202. The vacuum fitting has an extension extending within the vacuum spindle and forming a small clearance. A slight vacuum leak between the outer diameter of the vacuum fitting and the inner diameter of the opening of the vacuum spindle assures that no contact exists between the vacuum fitting and the imaging drum, which might impart uneven movement or jitters to the imaging drum during its rotation.

Figure 5:
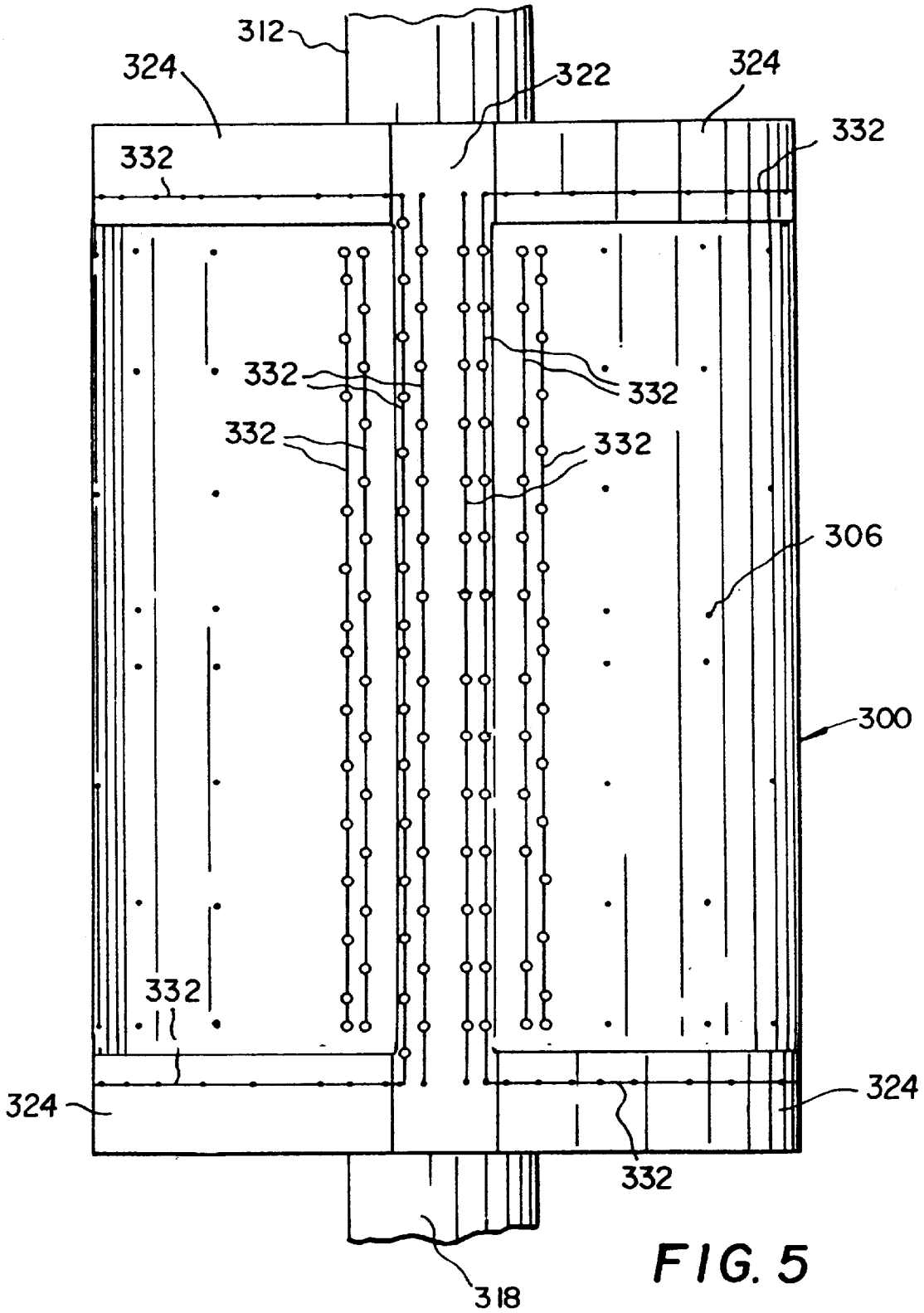
FIG. 5 is a plan view of a vacuum imaging drum surface according to the present invention.

Referring to FIG. 5, the outer surface of the imaging drum 300 is provided with an axially extending flat 322, which preferably extends approximately 8 degrees of the drum 300 circumference. The imaging drum 300 is provided with donor support rings 324, which form a radial recess 326 (see FIG. 4). This recess extends radially from one side of the axially extending flat 322 around the imaging drum 300 to the other side of the axially extending flat 322, from approximately one inch from one end of the imaging drum 300 to approximately one inch from the other end of the drum 300. Although a preferred embodiment herein does include an axially extending flat and a radial recess, the present invention need not include either.

The imaging drum axially extending flat has two main purposes. First, it assures that the leading and trailing ends of the dye donor sheet material are somewhat protected from the effect of air during the relatively high speed rotation that the imaging drum undergoes during the imaging process. Here, the air will have less tendency to lift the leading or trailing edges of the dye donor sheet material. The axially extending flat also ensures that the leading and trailing ends of the dye donor sheet material are recessed from the periphery of the imaging drum. This reduces the chance of the dye donor sheet material coming into contact with other parts of the image processing apparatus, such as the printhead. Such contact could cause a jam and possible loss of the intended image, or even catastrophic damage to the image processing apparatus.

The imaging drum axially extending flat also acts to impart a bending force to the ends of the dye donor sheet materials as they are held onto the imaging drum surface by vacuum from within the interior of the imaging drum. When the vacuum is turned off to that portion of the imaging drum, the end of the dye donor sheet material will tend to lift from the surface of the imaging drum. Thus turning off the vacuum eliminates the bending force on the dye donor sheet material, and is used as an advantage in the removal of the dye donor sheet material from the imaging drum.

Figure 6A:
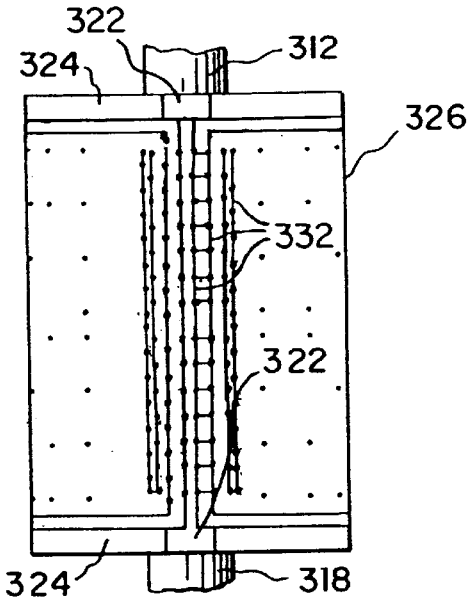
FIGS. 6A–6C are plan views of a vacuum imaging drum according to the present invention, showing a sequence of placement for thermal print media and dye donor sheet material.
Figure 6B:
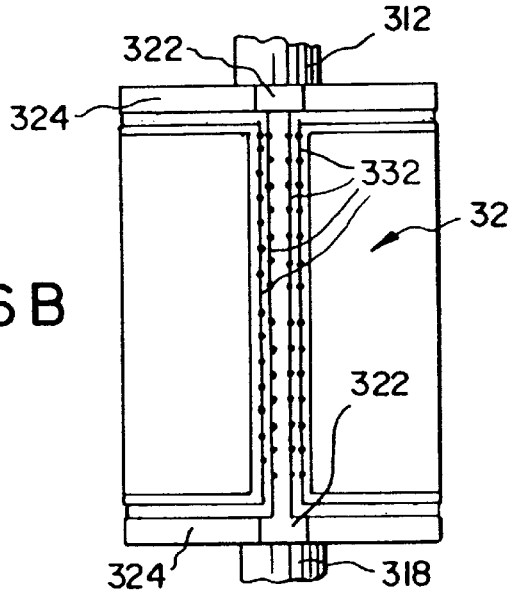
Figure 6C:
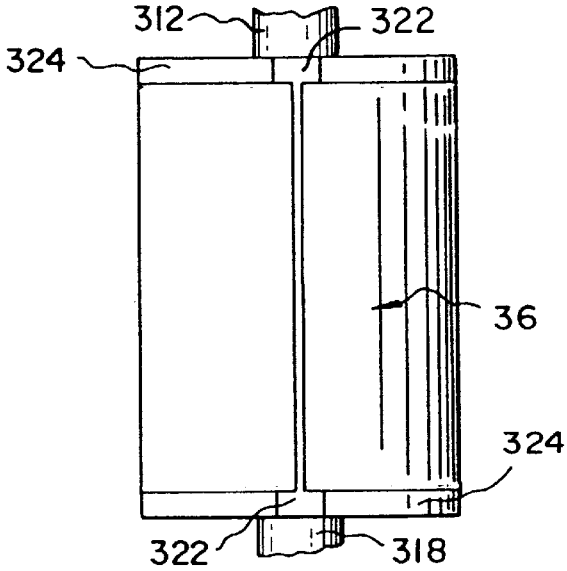

As shown in FIGS. 6A through 6C, the thermal print media 32 when mounted on the imaging drum 300 is seated within the radial recess 326. Therefore, the donor support rings 324 have a thickness which is substantially equal to the thickness of the thermal print media 32 seated therebetween. In this embodiment, this thickness is 0.004 inches. The purpose of the radial recess 326 on the imaging drum 300 surface is to eliminate any creases in the dye donor sheet material 36, as the materials are drawn down over the thermal print media 32 during the loading of the dye donor sheet material 36. This ensures that no folds or creases will be generated in the dye donor sheet material 36, which could extend into the image area and seriously adversely affect the intended image. The radial recess 326 also substantially eliminates the entrapment of air along the edge of the thermal print media 32, the vacuum holes 306 in the imaging drum 300 surface cannot always ensure the removal of the entrapped air. Any residual air between the thermal print media 32 and the dye donor sheet material 36 can also adversely affect the intended image.

Figure 7:
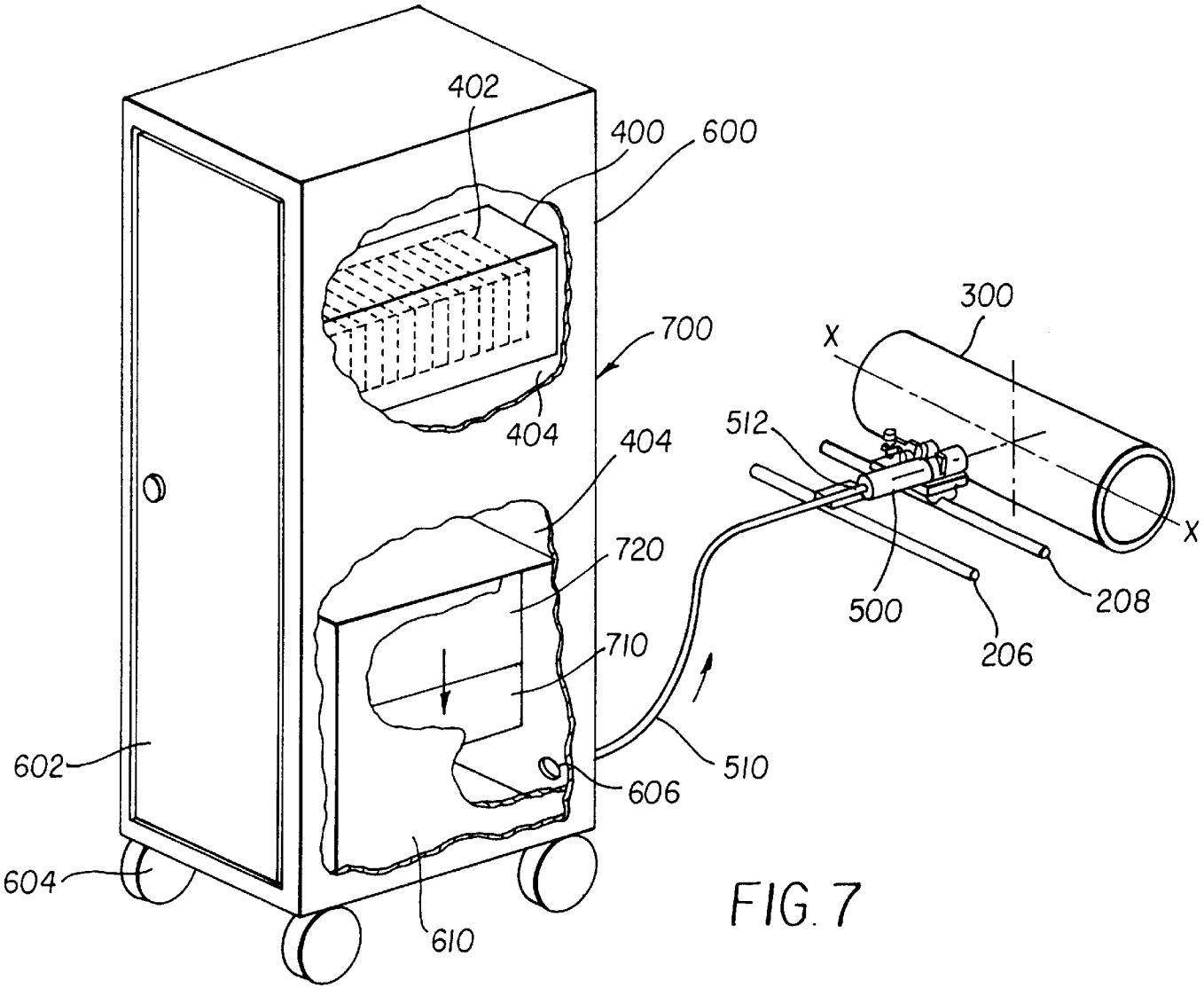
FIG. 7 is a perspective view of an image processing apparatus according to the present invention, showing an image system housing enclosing a cooler.
Figure 8:
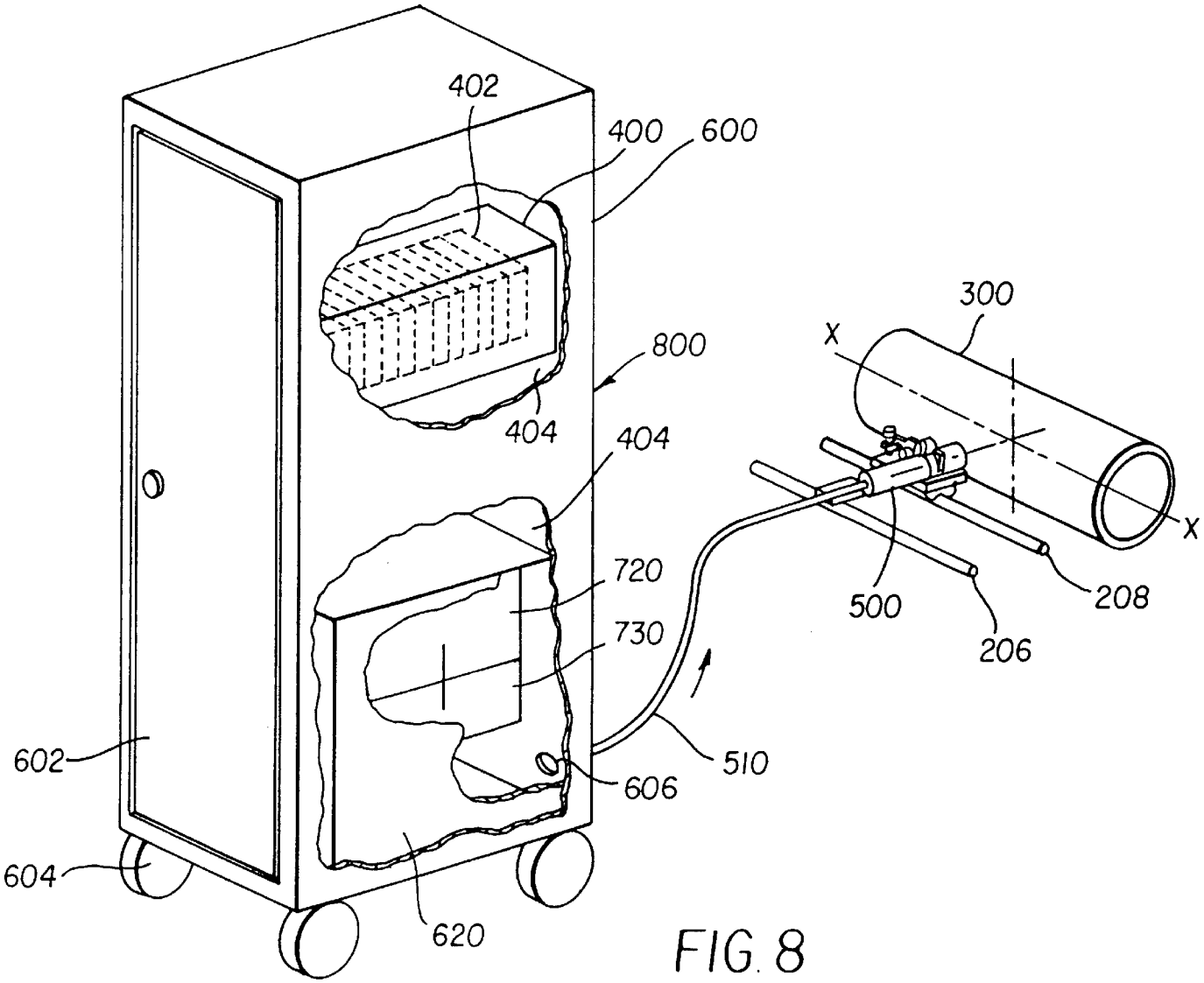
FIG. 8 is a perspective view of an alternate embodiment of an image processing apparatus according to the present invention, showing a blower and a conduit tube for channeling positive air to the printhead to blow away foreign particles.
Figure 9:
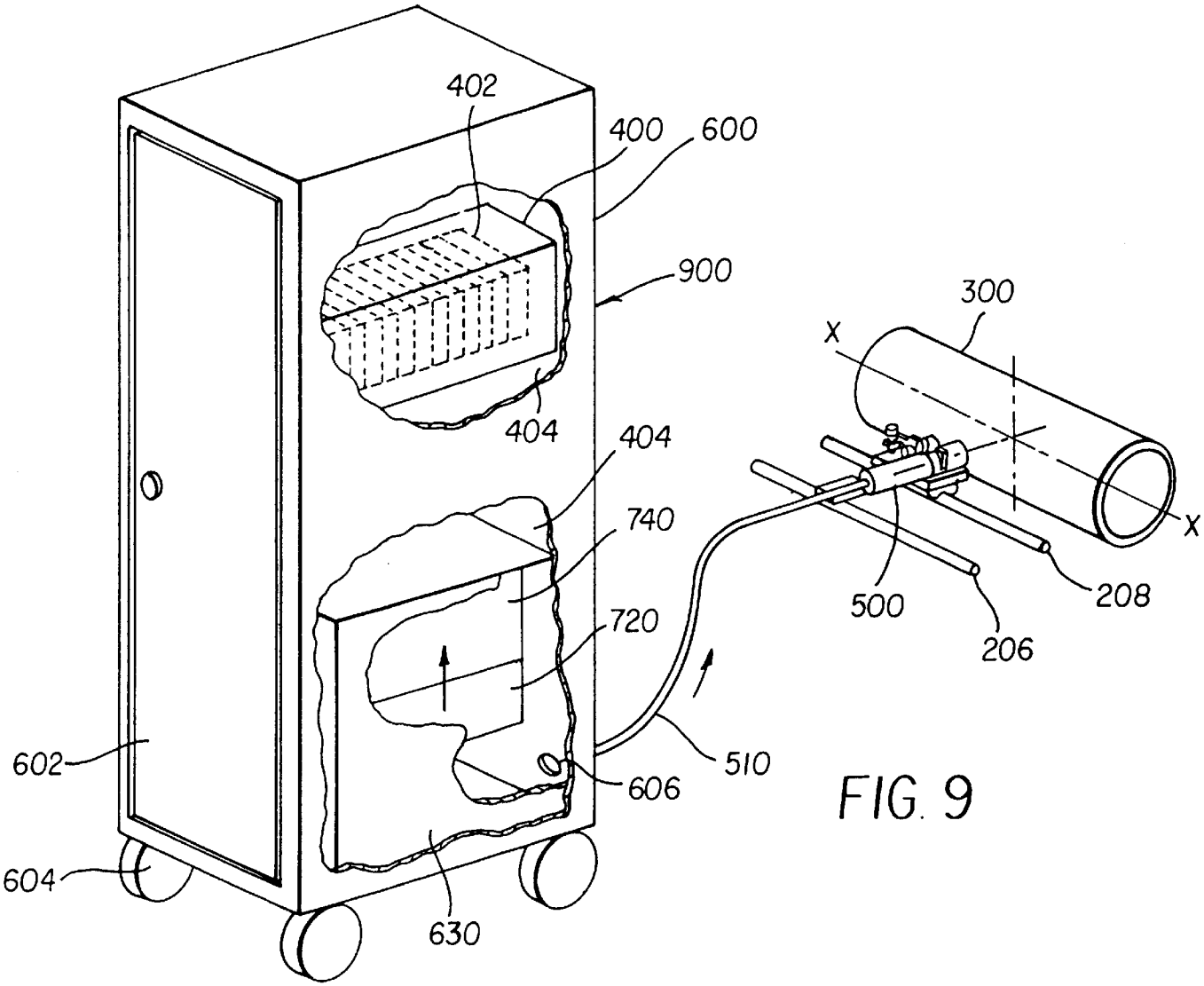
FIG. 9 is a perspective view of an alternate embodiment of an image processing apparatus, showing a vacuum blower and a conduit tube for channeling foreign particles from the printhead area.

FIGS. 7–9 are perspective views of alternate embodiments of image processing apparatus according to the present invention. The image processing apparatus 10 include separately housed imaging systems 700, 800, 900, which include a filtration system 720 and a cooler 710 or blower 730, 740 in an image system housing 600. The blower may be a positive air blower 730 or a vacuum blower 740. The filtration system 720, cooler 710, and/or blower 730, 740 are enclosed in a separate cooler or blower housing 610, 620, 630 within the image system housing 600. One of these imaging systems can be wheeled up next to a printing press or the like, and the desired image can be written using a laser, once the printhead is connected to the imaging system. The imaging system thus functions as a portable laser imaging head.

As shown in FIGS. 7 through 9, two translation bearing rods 206, 208 under the printhead 500 are arranged parallel to the axis X of the imaging drum 300. The axis of the printhead 500 is perpendicular to the axis X of the imaging drum 300 axis.

Temperatures within an image processing apparatus can get quite high. The image system housing 600 illustrated in FIGS. 7 through 9 is preferably remote from the rest of the image processing apparatus, which is represented in FIGS. 7 through 9 by the printhead 500 and imaging drum 300, in order to keep the laser assembly 400 and other equipment in the housing cool. There is also preferably a laser distribution box (not shown) between the lasers and the fiber optic cables 404. A number of fiber optic cables 404, preferably 64, emerge from the laser assembly 400. At some point within the image system housing 600, the fiber optic cables 404 are bundled together so that they are easier to handle. The fiber optic cable bundle passes through the conduit tube 510. The end of the conduit tube 510 may be within the housing 606, but it is preferably affixed to an aperture 606 on the outside of the image system housing 600. The opposite end 512 of the conduit tube 510 is connected to the back of the printhead 500.

The conduit tube 510 is preferably made of a plastic or metal that can withstand high temperatures, and it may be insulated. The conduit tube is most preferably about an inch or two in internal diameter, and the fiber optic bundle, or other connection means, ordinarily occupies only about one quarter of that space. Sufficient space remains in the conduit tube 510 for air to be blown or sucked through it.

FIG. 7 illustrates one possible arrangement of an imaging system 700 that includes a cooler 710 for cooling ambient air and shunting it down the conduit tube 510 to the printhead 500, lead screw 250, imaging lens 503, and surrounding area. The cooler 710 preferably cools ambient air to a temperature of between about 50 and 80 degrees Fahrenheit. The air temperature only rises a small amount by the time it emerges from the conduit tube 510 at the printhead 500. The cool air keeps the printhead 500 stable, and prevents the imaging lens 503 and printhead barrel from thermal expansion. Since the fiber optic cables 404 are insulated and bundled, the cool air does not damage the cables inside the conduit tube 510. However, if desired, the conduit tube 510 can be partitioned along its length, with the fiber optic cables 404 being contained on one side of the conduit tube 510, and the air passing down the other side of the conduit tube.

FIG. 8 shows an imaging system 800 with a blower 730, and a conduit tube 510 for channeling positive air flow from the blower 730 to the printhead 500. Frequently, foreign particles collect in the printhead area. Particles can be generated as a byproduct of oblating material during writing of the intended image. In the case of a printing press, for example, small ink particles are often generated from the ink rollers. When a printing plate is written in a printing press, a laser is focused on the printing plate, which vaporizes the media layer. The resulting particles, including dust, that collect in the printhead area can mar the image and over time cause parts of the image processing apparatus 10 to function poorly. Positive air flow generated by the blower 730 helps to rid the printhead 500 and surrounding area of these particles, including dust.

A filtration system 720 is shown above the blower 730 in FIG. 8, and the cooler 710 in FIG. 7. Air flows in the direction indicated by the arrows in FIGS. 7 and 8: down through the filtration system 720 and then the cooler 710, and then down through the conduit tube 510 to the printhead 500. The filtration system 720 filters ambient air before it enters the blower 730, or cooler 710, so that the foreign particle problem is not exacerbated by blowing additional particles into the printhead area through the conduit tube 510. Preferred filtration systems include replaceable filters. Filter size varies according to usage and type of image processing apparatus. Any suitable filter may be used, possibly including coalescing filters, and particulate filters.

FIG. 9 shows an imaging system 900 that includes a vacuum blower 740 for channeling foreign matter from the area of the printhead 500 through the conduit tube 510. Air flows in the direction indicated by the arrows in FIG. 9: from the printhead 500 up through the conduit tube 510, through the filtration system 720 in the image system housing 600, and then to the vacuum blower 740. The air-borne particles are collected on the filter in the filtration system 720, which is shown under the vacuum blower 740 in FIG. 13. The filtrate is periodically disposed of in an appropriate manner. Since the image system housing 600 is preferably remote from the rest of the apparatus 10, the filter may easily be accessed by the machine operator. Most preferably, a replaceable, removable filter can be accessed through a door 602 in the image system housing 600, as shown in FIG. 9. Some of the particles collected from the filtration system may be carcinogens, so disposal must be carefully monitored. The image system housing 600 is preferably on wheels 604, so that it can be moved, though it is attached to the remainder of the apparatus 10 by the umbilical-like conduit tube 510.

The imaging system 700, 800, 900 preferably includes dials or electrical controls so that the operator can regulate the amount of air flowing to the conduit tube, and/or the temperature of the air flowing to the conduit tube. The air may be cooled to a temperature sufficient to maintain the air around the printhead at approximately room temperature, or whatever temperature is optimal for that particular printhead or application. In one embodiment, a remote sensor in the printhead reads the printhead temperature, and signals the user when the temperature reaches a pre-set upper limit.

The imaging system 700, 800, 900 may alternatively include both a vacuum blower, and a cooler with a positive air blower. This embodiment preferably has controls for controlling the outflow of cool air to the conduit tube, or the inflow of air under vacuum from the conduit tube.

Keeping the printhead area and intended images free of foreign particles results in a cleaner image, reduces upkeep requirements, and decreases the number of malfunction requiring trouble-shooting. A cooler printhead means a longer lasting printhead and lead screw, and a better image, since the lens will not heat up as much. With cool air passing through it, the fiber optic tubing is not as likely to bum or melt in the high temperature environment inside the apparatus.

Figure 13:
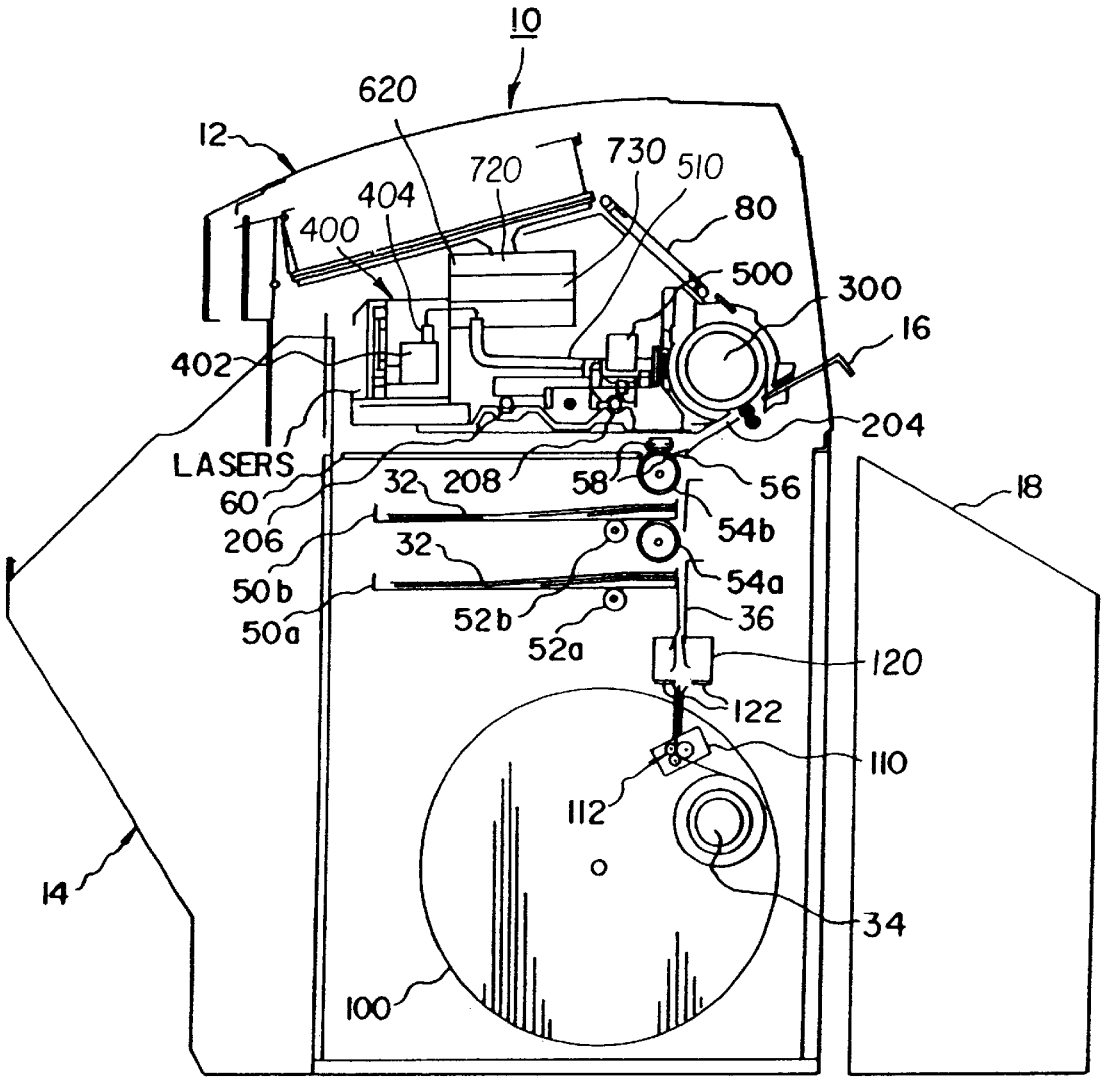
FIG. 13 is a side view in vertical cross-section of an alternate embodiment of an image processing apparatus according to the present invention, including an air blower.
Figure 14:
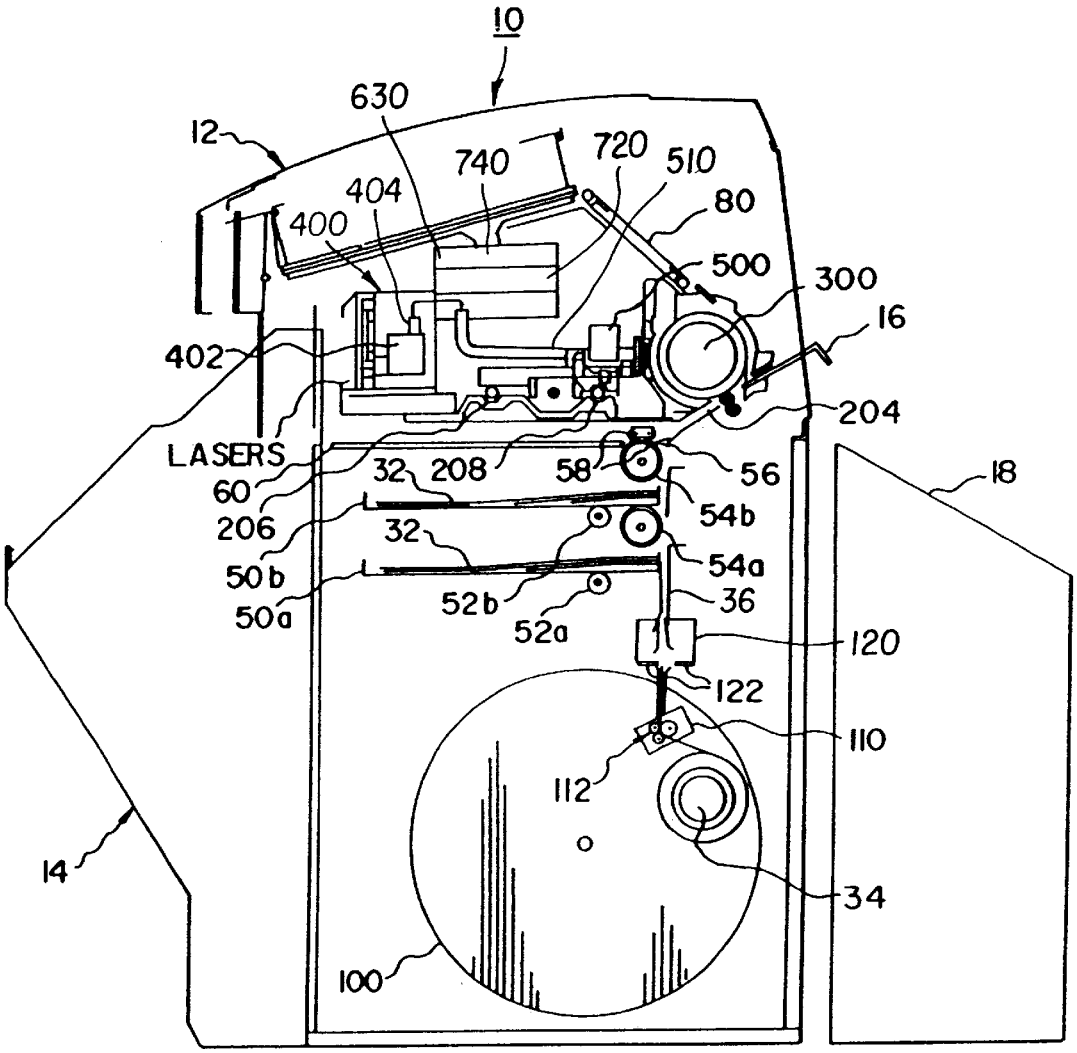
FIG. 14 is a side view in vertical cross-section of an alternate embodiment of an image processing apparatus according to the present invention, including a vacuum blower.

FIGS. 1, 13, and 14 are vertical cross-sections of alternate embodiments of image processing apparatus according to the present invention. Each image processing apparatus 10 includes a filtration system 720, and a cooler 710 or blower 730, 740. The blower may be a positive air blower 730 or a vacuum blower 740. FIGS. 1, 13 and 14 parallel FIGS. 7–9, as described above. The imaging devices of FIGS. 1, 13 and 14, though, already have a laser built into the device.

The image processing apparatus 10 shown in FIG. 1 includes a cooling unit 710 for cooling the printhead 500, lead screw 250, imaging lens 503, and the surrounding area.

The image processing apparatus 10 shown in FIG. 13 includes a positive air blower 730 to provide positive air to the printhead 500.

The image processing apparatus 10 of FIG. 14 includes a vacuum blower 740. Vacuum for use herein can be applied via a blower or pump, such as a centrifugal pump or a piston pump.

Figure 10:
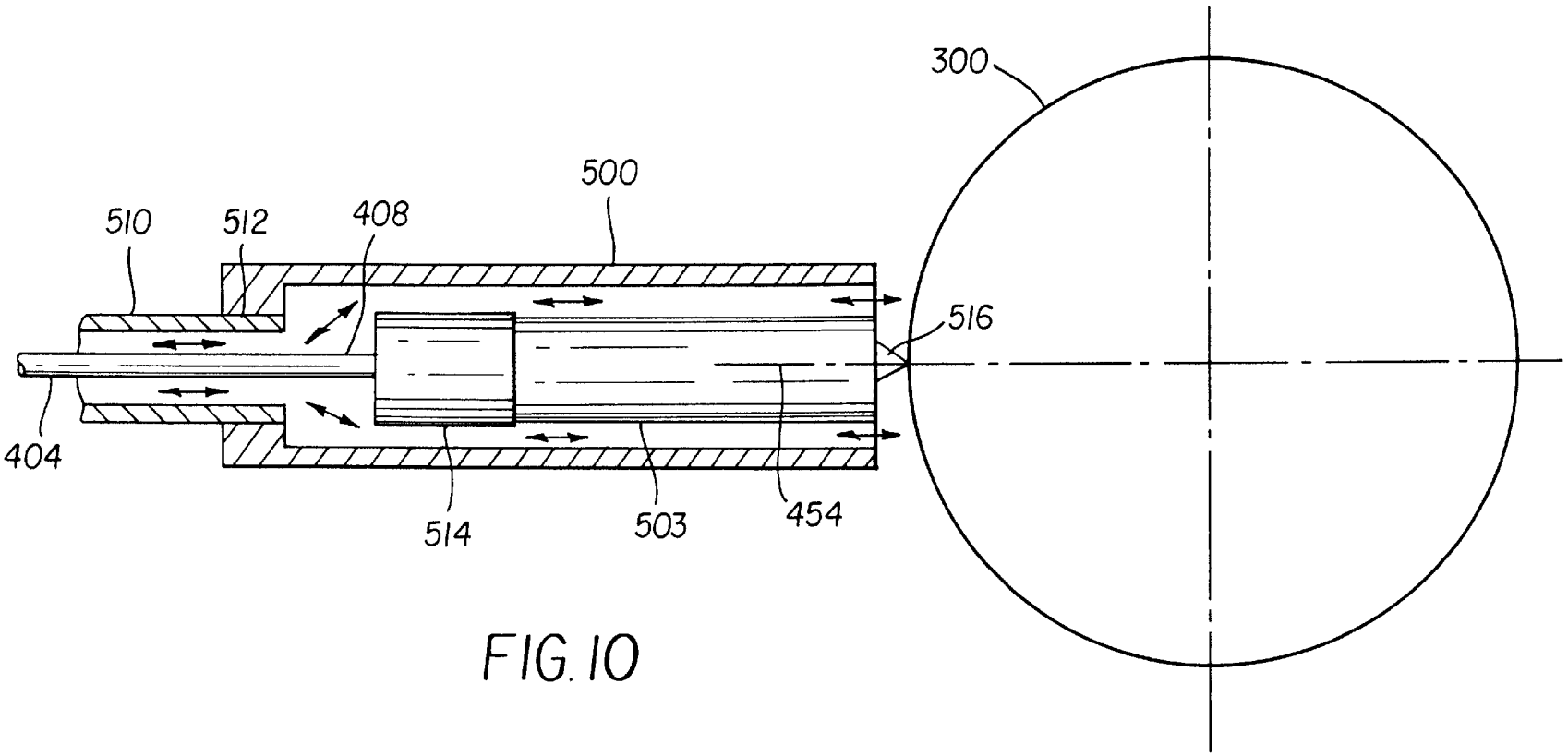
FIG. 10 is a schematic sectional view of a conduit tube and printhead according to the present invention.

FIG. 10 shows a cross-section of a conduit tube 510 attached to a printhead 500, which is directed at an imaging drum 300. The bundle of fiber optic cables 404 is shown extending down the center of the conduit tube 510. The end 512 of the conduit tube 510 is attached to the printhead 500. The ends 408 of the fiber optic cables 404 are mounted to the printhead termination block, or mounting block 514, which is attached to a imaging lens 503. V-grooves in the mounting block 514 hold the fiber optics. The ends of the fiber optics within the fiber optic cables are tied to a fiber optic array within the printhead. The optical centerline 454 is as indicated in FIG. 10.

Energy is emitted from the laser diodes and is transmitted via the fiber optic cables to the printhead. The imaging lens 503, which is mounted inside the printhead 500, directs energy from the printhead 500 to the imaging drum 300. The laser beam 516 from the printhead, which is represented in FIG. 10 by a triangle, is focused on the imaging drum 300.

When media 32 on the drum 300 is oblated, freed ink particles can end up on the imaging lens 503. Infrared energy is then absorbed by the coating of contaminants on the lens. The imaging lens thus heats up and it can crack or otherwise be destroyed. Cool air coming from the conduit tube 510 keeps the imaging lens 503 cool, clear and relatively free of air-borne particles, so that it does a better job.

The direction of air flow is indicated by the two headed arrows in FIG. 10, and depends on the type of blower being used. If a positive air blower 730 or cooler 710 is being used, the direction of air flow is toward the printhead 500 (to the right in FIG. 10). The air flows around the imaging lens 503 and blows out of the printhead 500 on either side of the lens 503, as indicated. From there, the positive air is blown into the space between the printhead 500 and the imaging drum 300. The air then blows to the left or right of the printhead. Once the air impacts the print media on the imaging drum 300, it soon loses pressure.

If a vacuum blower 740 is being employed, air is sucked away from the printhead 500 (to the left in FIG. 10) down the conduit tube 510 to the vacuum blower 740. When the vacuum is exerted, foreign particles are sucked down the conduit tube 510 with the air from the printhead/imaging drum area. The particles travel down either side of the imaging lens 503 and the mounting block 514 and into the end of the conduit tube. The particle-laden air flows beside the fiber optic cables 404 down the length of the conduit tube 510 to the filtration system 720, where the great majority of the foreign particles are trapped by filters. The fiber optic cables or other connection means may alternatively be enclosed in a tube within the conduit tube.

Figure 11:
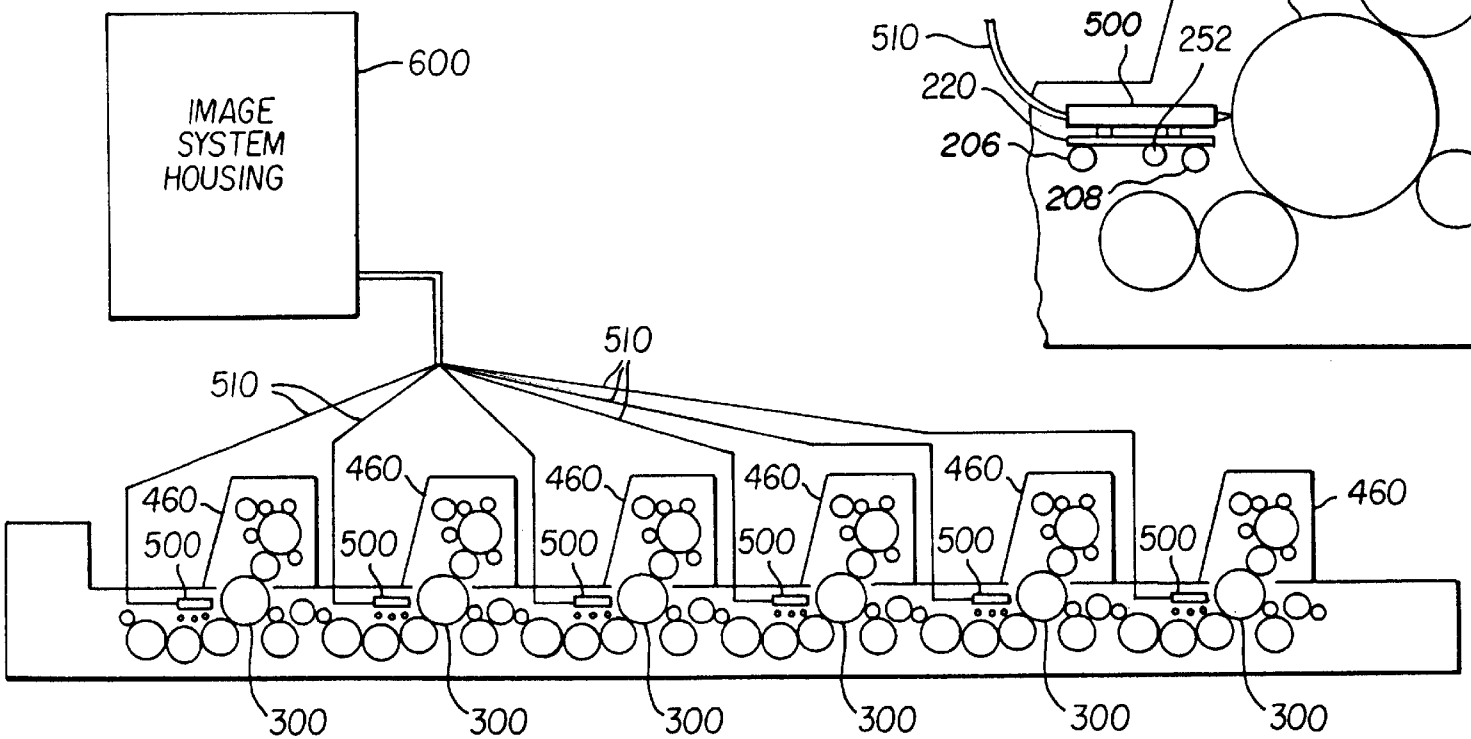
FIG. 11 is a schematic view of an image processing system according to the present invention, showing multiple stations in a printing press.

FIG. 11 shows one possible arrangement of several printing stations 460 built into a multiple-station image processing apparatus 462. For such an apparatus, the media being printed would be transported from printing station 460 to printing station 460, with each station 460 imaging with a different color.

Embodiments of the present invention with one printhead 500, such as the embodiments shown in FIGS. 7–9, preferably include only one conduit tube 510 enclosing all of the fiber optic cables 404. In contrast, embodiments with multiple printheads preferably include one conduit tube 510 for each printhead 500, as shown in FIG. 11. One end of each conduit tube 510 is affixed to the separate image system housing 600. The opposite end of each conduit tube 510 is connected to a printhead 500 at each printing station 460.

Figure 12:
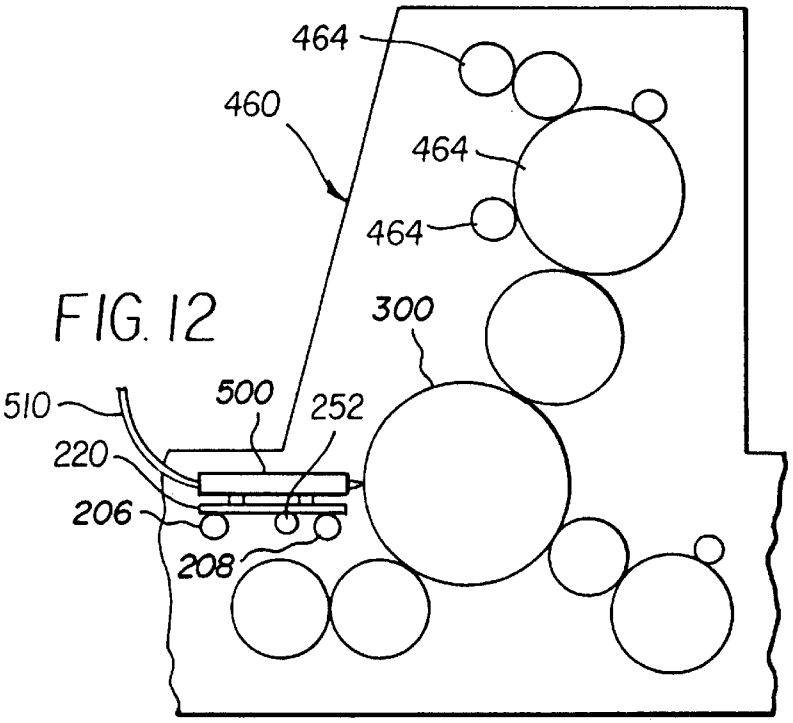
FIG. 12 is a plan view of one of the stations according to FIG. 11.

As shown in FIG. 12, each printing station 460 has its own printhead 500 and drum 300, with corresponding support components as described hereinabove. Here, the drum is usually a transfer drum. The drum may be indirectly driven by the motor, as is the case where a motor directly drives a driven roller, and, indirectly, associated tendency rollers. A translation stage member 220 under each printhead 500 includes parallel translation bearing rods 206, 208, with a threaded shaft 252 in between. The longitudinal axis of each printhead 500 is aligned perpendicular axis to the longitudinal axis (X) of the imaging drum 300. Each printhead 500 is movable relative to the longitudinal axis of its drum 300. The drums in the multiple station apparatus 462 are parallel to one another. Each station 460 includes a plurality of other rollers 464, such as ink transfer rollers.

In a printing press apparatus, temperatures in the area of the printhead can get very hot when the press is in idle mode or warming up, sometimes approaching several hundred degrees Fahrenheit. Channeling cooling air to the printhead area through the conduit tube 510 can prevent melting of the conduit tube, and lessen contamination of, and wear and tear on, the printhead and other parts of the apparatus. Also when the ink rollers in a printing press are rotated, the action of the ink being transferred to the printed media often causes ink particles to become airborne. This can contaminate the printhead. The blower or pump (positive or vacuum) of the present invention reduces the amount of airborne particles in the printhead area, thus decreasing contamination.

In sum, then, a preferred embodiment of an image processing apparatus 10 includes: a) a rotatable drum 300; b) a motor for rotating the drum 300; c) at least one movable printhead 500 external to the drum 300; d) an imaging assembly 400; e) at least one connection means for connecting the imaging assembly 400 to the printhead 500; f) at least one conduit tube 510 for conducting the connection means 404 between the imaging assembly and the printhead 500, one end of the conduit tube 510 being affixed to the printhead 500, an opposite end of the conduit tube being connected to the imaging assembly 400; and g) an air moving device connecting directly or indirectly to the conduit tube 510 at the opposite end of the conduit tube. A process for eliminating foreign particles from the printhead area is also included herein.

Although the air moving device (g) is preferably a cooler 710 or blower 730, 740, it may instead be one or more centrifugal pumps (e.g. with tube rollers), or piston pumps. The air moving device may be an air conditioner, or cool air can be provided by heat pumps, compressed air, freon, etc.

The imaging assembly is preferably a laser assembly, in which case the tubular connection means are fiber optic cables 404. The imaging assembly could also be an ink jet assembly, in which case the connection means are tubes for conducting the ink. The connection means could also be electrical wires or the like. The cables, tubes, or wires extend through the conduit tube to the printhead. Also, there can be more than one connection means tube within the conduit tube.

In a preferred embodiment of the apparatus 10:

1) A filtration system 720 precedes the cooler 710 (or positive air blower), as shown in FIG. 1.
2) The laser assembly 400, cooler 710 (or blower 730, 740), and filtration system 720 are enclosed by an image system housing 600, which is remote from the remainder of the image processing apparatus 10, as shown in FIG. 7.
3) The filtration system 720 and cooler 710 (or blower) are enclosed by a separate cooler housing 610 within the image system housing 600 (see FIG. 7).

A preferred alternate embodiment also includes:

1) Thermal print media 32 removably mounted on the drum 300, the printhead 500 being positioned to move over the thermal print media 32 on the drum 300.
2) At least one lead screw 250 for moving the printhead 500 in a first direction, the printhead 500 being mounted on the lead screw 250. The printhead can alternatively be moved by, for example, a linear motor, cable drive, hydraulic cylinder, or compressed air.
3) A linear translation subsystem 210 or subsystems on which the printhead 500, imaging drum 300, and lead screw 250 are mounted.
4) A plurality of the printheads 500 and an equal number of the lead screws 250 and drums 300; where each of the printheads is connected to one end of one of the conduit tubes, mounted on one of the lead screws, and directed at one of the drums, as shown in FIG. 11. More preferably, each conduit tube 510 is connected at an opposite end to a single image system housing 600, which encloses one laser assembly 400 and one cooler 710 (or blower), and is remote from the remainder of the image processing apparatus 10 (see FIG. 11).

An alternate, preferred embodiment for forming images on a thermal print media includes: a) at least one rotatable imaging drum 300; b) a motor for rotating the imaging drum 300; c) at least one movable printhead 500 external to the imaging drum 300; d) at least one lead screw 250 for moving the printhead 500 in a first direction, the printhead 500 being mounted on the lead screw 250; e) thermal print media 32 removably mounted on the imaging drum 300, the printhead 500 being positioned to move over the thermal print media 32 on the imaging drum 300; f) a laser assembly 400 comprising a plurality of laser diodes 402 connected to a plurality of fiber optic cables 404 connected to the printhead 500; g) at least one conduit tube 510 surrounding at least a portion of the fiber optic cables 404, one end of the conduit tube 510 being affixed to the printhead 500; and h) a cooler 710 or blower 730, 740 connecting directly or indirectly to the conduit tube 510 at an opposite end of the conduit tube.

This alternate embodiment preferably includes one or more of the following:

1) Thermal print media 32 removably mounted on the imaging drum 300, the printhead 500 being positioned to move over the thermal print media 32 on the imaging drum 300.
2) A linear translation subsystem 210 or subsystems on which the printhead 500, imaging drum 300, and lead screw 250 are mounted;
3) A positive air blower 730, with a filtration system 720 preceding it, as shown in FIG. 13, or a vacuum blower 740, with a filtration system 720 between it and the printhead 500, as shown in FIG. 14.
4) A removable, replaceable filter in the filtration system 720.
5) The laser assembly 400, blower 730, 740, and filtration system 720 are enclosed by an image system housing 600, which is remote from the remainder of the apparatus 10, as shown in FIGS. 8 and 9.
6) The filtration system 720 and blower are enclosed by a separate blower housing 620, 630 within the imaging system housing, as shown in FIGS. 8 and 9.

In a preferred embodiment shown in FIG. 11, the apparatus 10 includes a plurality of the printheads 500, and an equal number of the lead screws 250 and drums 300; and each of the printheads is connected to one end of one of the conduit tubes 510, mounted on one of the lead screws 250, and directed at one of the drums 300. In this embodiment, each conduit tube 510 is connected at an opposite end to a single image system housing 600, which encloses one laser assembly 400 and one blower 730 or 740, and is remote from the remainder of the image processing apparatus 10. This embodiment most preferably includes a vacuum blower 740, and a filtration system 720 between the printhead 500 and the vacuum blower 740. In this more preferred embodiment, the filtration system 720 is also enclosed by the image system housing 600.

Also included herein is an image producing process for blowing foreign particles from the printhead area, comprising the steps of: a) rotating a drum, preferably an imaging drum, in a direction of rotation; b) removably mounting a sheet of thermal print media on the drum; c) moving a printhead over the thermal print media on the rotating drum, the printhead being mounted on a lead screw on a translation system along with the drum; d) generating thermal energy using a plurality of laser diodes, and transmitting the thermal energy to the printhead by means of a plurality of fiber optic cables connected to the printhead; e) blowing air down through at least one conduit tube surrounding the fiber optic cables to the printhead; and f) writing an intended image on the thermal print media using the printhead.

Preferably, step e) further comprises cooling the air prior to blowing it down the conduit tube to the printhead, thereby cooling the printhead and lead screw. Step e) also preferably further comprises filtering the air prior to blowing it down the conduit tube.

An alternate image producing process for vacuuming foreign particles from the printhead area, comprises the steps of: a) rotating an imaging drum; b) removably mounting a sheet of thermal print media on the imaging drum; c) moving a printhead over the thermal print media on the rotating imaging drum, the printhead being mounted on a lead screw on a translation system along with the imaging drum; d) generating thermal energy using a plurality of laser diodes, and transmitting the thermal energy to the printhead by means of a plurality of fiber optic cables connected to the printhead; e) pulling a vacuum in at least one conduit tube surrounding the fiber optic cables, the conduit tube being connected at one end to the printhead, and vacuuming foreign particles from the printhead area; and f) writing an intended image on the thermal print media using the printhead.

This process preferably further comprises the step of e2) filtering the vacuumed air from the conduit tube. Step e2) follows step e). The steps can be carried on in sequence at a plurality of stations, each station including one imaging drum and one printhead attached to one end of one conduit tube.

Another image producing process herein for blowing or vacuuming foreign particles from the printhead area, includes the steps of: a) rotating an imaging drum in a direction of rotation; b) removably mounting a sheet of thermal print media on the imaging drum; c) moving a printhead over the thermal print media on the rotating imaging drum, the printhead being mounted on a lead screw on a translation system along with the imaging drum; d) generating thermal energy using a plurality of laser diodes, and transmitting the thermal energy to the printhead by means of a plurality of fiber optic cables connected to the printhead; e) alternately blowing air down through at least one conduit tube surrounding the fiber optic cables to the printhead, and vacuuming air from the conduit tube; and f) writing an intended image on the thermal print media using the printhead.

Preferably, in step e), the air is cooled before it is blown down the conduit tube.

The present invention is applicable to any imaging apparatus that uses a lead screw for printhead positioning. The movable end of the lead screw can be moved in any direction to provide the necessary offset from parallel, allowing this method to be used where space is at a premium. The invention can be used with an imaging system that uses dye or other colorant materials, printing plates, or films for processing an intended image. Although not described in detail, it would be obvious to someone skilled in the art that this invention could be used in various other imaging applications where an imaging device is used.

The invention has been described in detail with particular reference to certain preferred embodiments thereof, but it will be understood that variations and modifications can be effected within the spirit and scope of the invention as described hereinabove and as defined in the appended claims by a person of ordinary skill in the art, without departing from the scope of the invention. While preferred embodiments of the invention have been described using specific terms, this description is for illustrative purposes only. It is intended that the doctrine of equivalents be relied upon to determine the fair scope of these claims in connection with any other person's product which fall outside the literal wording of these claims, but which in reality do not materially depart from this invention.

PARTS LIST

10. Image processing apparatus
12. Image processor housing
14. Image processor door
16. Donor ejection chute
18. Donor waste bin
20. Media stop
22. Exit tray
30. Roll media
32. Thermal print media
34. Dye donor roll material
36. Dye donor sheet material
50. Sheet material trays
50*a*. Lower sheet thermal print material tray
50*b*. Upper sheet input image material tray
52. Media lift cams
52*a*. Lower media lift cam
52*b*. Upper media lift cam
54. Media rollers
54*a*. Lower media roller
54*b*. Upper media roller
56. Media guide
58. Media guide rollers
60. Media staging tray
80. Transport mechanism
100. Media carousel
110. Media drive mechanism
112. Media drive rollers
120. Media knife assembly
122. Media knife blades
200. Lathe bed scanning subsystem
202. Lathe bed scanning frame
204. Entrance passageway
206. Rear translation bearing rod
208. Front translation bearing rod
210. Translation system
220. Translation stage member
250. Lead screw
252. Threaded shaft
254. Lead screw drive nut
258. Translator drive linear motor
260. Axial load magnets
260*a*. Axial load magnet
260*b* Axial load magnet
262. Circular-shaped boss
264. Ball bearing
266. Circular-shaped insert
268. End cap
270. Hollowed-out center portion
272. Radial bearing
300. Rotatable drum
301. Axis of rotation
302. Drum housing
304. Hollowed-out interior portion
306. Vacuum hole
308. Vacuum end plate
310. Drive end plate
312. Drive spindle
318. Vacuum spindle
320. Central vacuum opening
322. Axially extending flat
324. Donor support ring
326. Radial recess
332. Vacuum grooves
346. First radial recess
348. Second radial recess
350. Load roller
400. Laser assembly
402. Laser diodes
404. Fiber optic cables
408. Ends of fiber optic cables at printhead
454. Optical centerline
460. Printing station
462. Multiple-station image processing apparatus
464. Printing press rollers
500. Printhead
502. Fiber mount
503. Imaging lens
510. Conduit tube
512. End of conduit tube at printhead

514. Mounting block
516. Laser beam
600. Image system housing
602. Housing door
604. Housing wheels
606. Aperture in housing
610. Cooler housing
620. Blower housing
630. Vacuum blower housing
700. Imaging system with cooler
710. Cooler
720. Filtration system
730. Positive air blower
740. Vacuum blower
800. Imaging system with blower
900. Imaging system with vacuum

What is claimed is:

1. An image processing apparatus for forming images on a thermal print media, comprising:

a) at least one rotatable imaging drum;

b) a motor for rotating the imaging drum;

c) at least one movable printhead external to the imaging drum;

d) at least one lead screw for moving the printhead in a first direction, the printhead being mounted on the lead screw;

e) thermal print media removably mounted on the imaging drum, the printhead being positioned to move over the thermal print media on the imaging drum;

f) a laser assembly comprising a plurality of laser diodes connected to a plurality of fiber optic cables connected to the printhead;

g) at least one conduit tube surrounding at least a portion of the fiber optic cables, one end of the conduit tube being affixed to the printhead;

h) a cooler or blower connecting directly or indirectly to the conduit tube at an opposite end of the conduit tube;

a linear translation subsystem or subsystems on which the printhead, imaging drum, and lead screw are mounted;

wherein said apparatus comprises a plurality of the printheads, and an equal number of the lead screws, imaging drums, and conduit tubes; each of the printheads being connected to one end of one of the conduit tubes, mounted on one of the lead screws, and directed at one of the imaging drums;

wherein each conduit tube is connected at an opposite end to a single image system housing, the image system housing enclosing one laser assembly and one blower or cooler, the image system housing being remote from the remainder of the image processing apparatus; and wherein the blower is a vacuum blower.

2. An apparatus according to claim 1 further comprising a filtration system preceding the blower.

3. An apparatus according to claim 1 further comprising a filtration system between the printhead and the vacuum blower.

4. An apparatus according to claim 1 further comprising a filtration system between the printhead and the vacuum blower, the filtration system also being enclosed by the image system housing.

5. An image processing apparatus for forming images on a thermal print media, comprising:

a) at least one rotatable imaging drum;

b) a motor for rotating the imaging drum;

c) at least one movable printhead external to the imaging drum;

d) at least one lead screw for moving the printhead in a first direction, the printhead being mounted on the lead screw;

e) thermal print media removably mounted on the imaging drum, the printhead being positioned to move over the thermal print media on the imaging drum;

f) a laser assembly comprising a plurality of laser diodes connected to a plurality of fiber optic cables connected to the printhead;

g) at least one conduit tube surrounding at least a portion of the fiber optic cables, one end of the conduit tube being affixed to the printhead;

h) a cooler or blower connecting directly or indirectly to the conduit tube at an opposite end of the conduit tube; and wherein the blower is a vacuum blower, and further comprising a cooler having a positive air blower.

6. An apparatus according to claim 5 further comprising controls for controlling the outflow of cool air to the conduit tube, or the inflow of air under vacuum from the conduit tube.

7. An image producing process for vacuuming foreign particles from the printhead area, comprising the steps of:

a) rotating a drum;

b) removably mounting a sheet of thermal print media on the drum;

c) moving a printhead over the thermal print media on the rotating drum;

d) generating thermal energy using a plurality of laser diodes, and transmitting the thermal energy to the printhead by means of a plurality of fiber optic cables connected to the printhead;

e) pulling a vacuum in at least one conduit tube surrounding the fiber optic cables, the conduit tube being connected at one end to the printhead, and vacuuming foreign particles from the printhead area; and f) writing an intended image on the thermal print media using the printhead.

8. A process according to claim 7 further comprising the step of e2) filtering the vacuumed air from the conduit tube, the step e2) following step e).

9. A process according to claim 7 wherein the steps are carried on in sequence at a plurality of stations, each station comprising one drum and one printhead attached to one end of one conduit tube.

10. An image producing process for blowing or vacuuming foreign particles from the printhead area, comprising the steps of:

a) rotating a drum in a direction of rotation;

b) removably mounting a sheet of thermal print media on the drum;

c) moving a printhead over the thermal print media on the rotating drum;

d) generating thermal energy using a plurality of laser diodes, and transmitting the thermal energy to the printhead by means of a plurality of fiber optic cables connected to the printhead;

e) alternately blowing air down through at least one conduit tube surrounding the fiber optic cables to the printhead, and vacuuming air from the conduit tube; and f) writing an intended image on the thermal print media using the printhead.

11. A process according to claim 10 wherein the printhead is mounted on a lead screw on a translation system along with the drum.

12. A process according to claim 11 wherein step e) further comprises cooling the air before it is blown down the conduit tube.

* * * * *